US011827018B2

(12) United States Patent
McAvoy

(10) Patent No.: US 11,827,018 B2
(45) **Date of Patent: *Nov. 28, 2023**

(54) DROPLET EJECTOR

(71) Applicant: 3C PROJECT MANAGEMENT LIMITED, Greystones (IE)

(72) Inventor: Gregory John McAvoy, Greystones (IE)

(73) Assignee: 3C PROJECT MANAGEMENT LIMITED, Greystones (IE)

( * ) Notice: Subject to any disclaimer, the term of this patent is extended or adjusted under 35 U.S.C. 154(b) by 0 days.

This patent is subject to a terminal disclaimer.

(21) Appl. No.: 17/741,577

(22) Filed: May 11, 2022

(65) Prior Publication Data

US 2022/0324230 A1 Oct. 13, 2022

Related U.S. Application Data

(63) Continuation of application No. 16/971,010, filed as application No. PCT/EP2019/054776 on Feb. 26, 2019, now Pat. No. 11,400,710.

(30) Foreign Application Priority Data

Feb. 27, 2018 (GB) ..... 1803177

(51) Int. Cl.
*B41J 2/14* (2006.01)

(52) U.S. Cl.
CPC ..... *B41J 2/14233* (2013.01)

(58) Field of Classification Search
CPC ..... B41J 2/14233; B41J 2002/1437; B41J 2202/15; B41J 2202/18
See application file for complete search history.

(56) References Cited

U.S. PATENT DOCUMENTS 5,666,144 A 9/1997 Zhang
6,428,140 B1 * 8/2002 Cruz-Uribe ..... B41J 2/14201 347/20

(Continued)

FOREIGN PATENT DOCUMENTS

CN 107310273 11/2017
JP 2004-025476 1/2004

(Continued)

OTHER PUBLICATIONS

International Search Report and Written Opinion of the ISA for PCT/EP2019/054776, dated May 10, 2019, 14 pages.

(Continued)

*Primary Examiner* — Lisa Solomon
(74) *Attorney, Agent, or Firm* — Nixon & Vanderhye P.C.

(57) ABSTRACT

A droplet ejector for a printhead comprises: a substrate having a mounting surface and an opposite nozzle surface; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the said nozzle-forming layer, the said nozzle portion comprising an inner portion located closer to the fluid chamber outlet and an outer portion located closer to a periphery of the nozzle portion; and either or both of an inner actuator arrangement formed on the inner portion of the nozzle portion of the nozzle-forming layer and an outer actuator arrangement formed on the outer portion of the nozzle portion of the nozzle-forming layer.

24 Claims, 19 Drawing Sheets

(56) References Cited

U.S. PATENT DOCUMENTS

| | | | |
|---|---|---|---|
| 7,992,969 | B2 | 8/2011 | Tanaka et al. |
| 8,061,820 | B2 | 11/2011 | Ottosson et al. |
| 8,727,471 | B2 | 5/2014 | Ottosson et al. |
| 2005/0024400 | A1 | 2/2005 | Satake et al. |
| 2009/0289998 | A1 | 11/2009 | Tanaka et al. |
| 2010/0214368 | A1 | 8/2010 | Kim et al. |
| 2013/0070030 | A1 | 3/2013 | Kusunoki et al. |
| 2013/0222481 | A1 | 8/2013 | Yokoyama et al. |
| 2013/0271530 | A1 | 10/2013 | Yokoyama et al. |
| 2014/0063095 | A1 | 3/2014 | Yokoyama et al. |
| 2014/0063131 | A1 | 3/2014 | Arai et al. |
| 2014/0071204 | A1 | 3/2014 | Kusunoki et al. |
| 2014/0118431 | A1 | 5/2014 | Govyadinov et al. |
| 2016/0279933 | A1 | 9/2016 | Arai et al. |
| 2017/0313075 | A1 | 11/2017 | Arai et al. |
| 2019/0283424 | A1 | 9/2019 | McAvoy |
| 2020/0391510 | A1 | 12/2020 | McAvoy |

FOREIGN PATENT DOCUMENTS

| | | | |
|---|---|---|---|
| JP | 2009010926 | A | 1/2009 |
| JP | 2014046580 | A | 3/2014 |
| JP | 2015058666 | A | 3/2015 |
| JP | 2015123547 | A | 7/2015 |
| KR | 10-2010-0096905 | | 9/2010 |

OTHER PUBLICATIONS

IP.com search (Year: 2021).

3-D Printing Piezoelectric Films, Rob Matheson—MIT News Office, Aug. 28, 2019, Electrospraying Nanoparticles, [retrieved on Sep. 28, 2021] (Year: 2019).

Wikipedia Article: List of piezoelectric materials, Jul. 1, 2021, Table, [retrieved on Sep. 28, 2021] (Year: 2021).

Piezoelectric materials for ultrasonic probes, M. Lach, M. Platte, A. Ries, Sep. 1, 1996, vol. 1, No. 09, [retrieved on Sep. 28, 2021] (Year: 1996).

* cited by examiner

FIG. 19

| Material | Deposition Method | Peak Temperature | CMOS compatability | $d_{31}$ (pC/N) |
|---|---|---|---|---|
| PZT | PVD + Anneal + Poling | >450°C | No | -152 to -259 |
| PZT | Sol Gel + Anneal + Poling | 650°C | No | -116 |
| ZnO | PVD | Room Temp | Yes | -3.3 |
| AlN | PVD | 200° C | Yes | -1.9 |
| ScAlN | PVD | Room Temp | Yes | -5.8 |

Table 1

DROPLET EJECTOR

The present application is a continuation application of U.S. application Ser. No. 16/971,010 filed on Aug. 19, 2020, which is the U.S. national phase of International Application No. PCT/EP2019/054776 filed 26 Feb. 2019, which designated the U.S. and claims priority to GB Patent Application No. 1803177.3 filed 27 Feb. 2018. The entire contents of each of these applications are incorporated herein by reference.

FIELD OF THE INVENTION

The invention relates to droplet ejectors for printheads, printheads comprising droplet ejectors, printers comprising printheads comprising droplet ejectors and methods for actuating droplet ejectors for printheads.

BACKGROUND TO THE INVENTION

Inkjet printers are used to recreate digital images on a print medium (such as paper) by propelling droplets of ink onto the medium. Many inkjet printers incorporate "drop on demand" technology wherein the sequential ejection of individual ink droplets from the inkjet nozzle of a printhead is controlled. The ink droplets are ejected with sufficient momentum that they adhere to the medium. Each droplet is ejected according to an applied drive signal, which differentiates drop on demand inkjet printers from continuous inkjet devices where a continuous stream of ink droplets is generated by pumping ink through a microscopic nozzle.

Two of the most commercially successful drop on demand technologies are thermal inkjet printers and piezoelectric inkjet printers. Thermal inkjet printers require the printing fluid to include a volatile component, such as water. A heating element causes the spontaneous nucleation of a bubble in the volatile fluid within the printhead, forcing a droplet of fluid to be ejected through a nozzle. Piezoelectric inkjet printers instead incorporate a piezoelectric actuator into a wall of a fluid chamber. Deformation of a piezoelectric element causes deflection of the piezoelectric actuator, inducing a pressure change in the printing fluid stored within the fluid chamber and thereby causing droplet ejection through a nozzle.

Thermal inkjet printers can only be used to jet a very small subset of printing fluids (as the fluids must exhibit the appropriate volatility). Thermal inkjet printers also suffer from kogation, wherein dried ink residue deposits on the heating element, which reduces their usable lifetime.

Piezoelectric inkjet printers are usable with a range of fluids and have longer operational lifetimes than thermal inkjet printers, because they do not suffer from kogation. However, only very low nozzle counts per printhead are typically achievable with existing piezoelectric technologies compared to thermal inkjet printheads.

Aspects of the present invention aim to provide an improved piezoelectric droplet ejector for a printhead which permits higher nozzle counts to be achieved.

SUMMARY OF THE INVENTION

A first aspect of the invention provides a droplet ejector for a printhead. The droplet ejector comprises: a substrate having a mounting surface and an opposite nozzle surface; a nozzle-forming layer formed on at least a portion of the nozzle surface of the substrate; and a fluid chamber defined at least in part by the substrate and at least in part by the nozzle-forming layer. The fluid chamber has a fluid chamber outlet defined at least in part by a nozzle portion of the said nozzle-forming layer.

The nozzle portion of the nozzle-forming layer typically functions as (e.g. forms or is) a diaphragm for ejecting fluid from the fluid chamber through the fluid chamber outlet. The diaphragm is typically movable. The diaphragm is typically flexible. Movement (e.g. flexing) of the diaphragm towards (i.e. into) the fluid chamber typically causes expulsion of fluid through the fluid chamber outlet.

The droplet ejector typically further comprises at least one actuator arrangement (e.g. one or more actuators) formed on at least a portion of the nozzle portion of the nozzle-forming layer (e.g. the diaphragm). The at least one actuator arrangement (e.g. the one or more actuators) is typically configured (e.g. positioned) to (i.e. in use) move or flex the nozzle portion of the nozzle-forming layer (e.g. the diaphragm) on actuation.

The at least one actuator arrangement (e.g. the one or more actuators) may comprise (e.g. consist of) an inner actuator arrangement (e.g. one or more inner actuators). The inner actuator arrangement (e.g. the one or more inner actuators) is typically an actuator arrangement formed on at least a portion of the nozzle portion of the nozzle-forming layer (e.g. the diaphragm) adjacent the fluid chamber outlet. That is to say, the inner actuator arrangement (e.g. the one or more inner actuators) is typically an actuator arrangement formed on at least a portion of the nozzle portion of the nozzle-forming layer (e.g. the diaphragm) which is closer to the fluid chamber outlet than a periphery (e.g. outer perimeter) of the nozzle portion of the nozzle-forming layer (e.g. the diaphragm).

The at least one actuator arrangement (e.g. the one or more actuators) may comprise (e.g. consist of) an outer actuator arrangement (e.g. one or more outer actuators). The outer actuator arrangement (e.g. the one or more outer actuators) is typically an actuator arrangement formed on at least a portion of the nozzle portion of the nozzle-forming layer (e.g. the diaphragm) adjacent the periphery (e.g. outer perimeter) of the nozzle portion of the nozzle-forming layer (e.g. the diaphragm). That is to say, the outer actuator arrangement (e.g. the one or more outer actuators) is typically an actuator arrangement formed on at least a portion of the nozzle portion of the nozzle-forming layer (e.g. the diaphragm) which is closer to the periphery (e.g. outer perimeter) of the nozzle portion of the nozzle-forming layer (e.g. the diaphragm) than the fluid chamber outlet.

It may be that the droplet ejector comprises both an inner actuator arrangement (e.g. one or more inner actuators) and an outer actuator arrangement (e.g. one or more outer actuators). Alternatively, it may be that the droplet ejector comprises an inner actuator arrangement (e.g. one or more inner actuators) or an outer actuator arrangement (e.g. one or more outer actuators) but not both. That is to say, the presence of an inner actuator arrangement (e.g. one or more inner actuators) does not necessarily imply the presence of an outer actuator arrangement (e.g. one or more outer actuators) and, vice versa, the presence of an outer actuator arrangement (e.g. one or more outer actuators) does not necessarily imply the presence of an inner actuator arrangement (e.g. one or more inner actuators).

The nozzle portion of the nozzle-forming layer (e.g. the diaphragm) typically comprises (e.g. consists of) an inner portion and an outer portion.

The inner portion of the nozzle portion of the nozzle-forming layer (e.g. the diaphragm) is typically a portion of the nozzle portion located adjacent the fluid chamber outlet.

The inner portion of the nozzle portion of the nozzle-forming layer (e.g. the diaphragm) is typically a portion of the nozzle portion located closer to the fluid chamber outlet than to the periphery (e.g. outer perimeter) of the nozzle portion of the nozzle-forming layer (e.g. the diaphragm). The inner portion of the nozzle portion of the nozzle-forming layer (e.g. the diaphragm) may be a portion of the nozzle portion which abuts (i.e. extend up to) the fluid chamber outlet. The inner portion of the nozzle portion of the nozzle-forming layer (e.g. the diaphragm) may be a portion of the nozzle portion which at least partially surrounds the fluid chamber outlet. The inner portion of the nozzle portion of the nozzle-forming layer (e.g. the diaphragm) may be a portion of the nozzle portion which completely surrounds the fluid chamber outlet. The inner portion of the nozzle portion of the nozzle-forming layer (e.g. the diaphragm) may be a portion of the nozzle portion which comprises the fluid chamber outlet (i.e. the fluid chamber outlet may extend through the inner portion of the nozzle portion of the nozzle-forming layer (e.g. the diaphragm).

The outer portion of the nozzle portion of the nozzle-forming layer (e.g. the diaphragm) is typically a portion of the nozzle portion provided adjacent the periphery (e.g. outer perimeter) of the nozzle portion of the nozzle-forming layer (e.g. diaphragm). The outer portion of the nozzle portion of the nozzle-forming layer (e.g. the diaphragm) is typically a portion of the nozzle portion provided closer to the periphery (e.g. outer perimeter) of the nozzle portion of the nozzle-forming layer (e.g. the diaphragm) than the fluid chamber outlet. The outer portion of the nozzle portion of the nozzle-forming layer (e.g. the diaphragm) may be a portion of the nozzle portion which abuts (i.e. extend up to) the inner portion of the nozzle portion of the nozzle-forming layer (e.g. the diaphragm). The outer portion of the nozzle portion of the nozzle-forming layer (e.g. the diaphragm) is typically a portion of the nozzle portion provided at least partially around the inner portion of said nozzle portion of the nozzle-forming layer (e.g. the diaphragm). The outer portion of the nozzle portion of the nozzle-forming layer (e.g. the diaphragm) may be a portion of the nozzle portion which at least partially surrounds the inner portion of the nozzle portion of the nozzle-forming layer (e.g. the diaphragm). The outer portion of the nozzle portion of the nozzle-forming layer (e.g. the diaphragm) may be a portion of the nozzle portion which completely surrounds the inner portion of the nozzle portion of the nozzle-forming layer (e.g. the diaphragm). The outer portion of the nozzle portion of the nozzle-forming layer (e.g. the diaphragm) may be a portion of the nozzle portion which abuts (i.e. extend up to) the periphery (e.g. outer perimeter) of the nozzle portion of the nozzle-forming layer (e.g. the diaphragm). The outer portion of the nozzle portion of the nozzle-forming layer (e.g. the diaphragm) may be a portion of the nozzle portion which extends between the inner portion of the nozzle portion of the nozzle-forming layer (e.g. the diaphragm) and the periphery (e.g. outer perimeter) of the nozzle portion of the nozzle-forming layer (e.g. the diaphragm).

The inner portion of the nozzle portion of the nozzle-forming layer is typically a portion of the nozzle-forming layer which is curved on actuation. The outer portion of the nozzle portion of the nozzle-forming layer is typically a portion of the nozzle-forming layer which is curved on actuation. The said outer and inner portions typically curve in opposite directions (i.e. face in opposite directions) when curved on actuation. Accordingly, when viewed from one direction (e.g. from a point outside the fluid chamber), one of the inner portion and the outer portion typically appears incurvate and the other of the inner portion and the outer portion typically appears excurvate on actuation.

It may be that the at least one actuator arrangement (e.g. the at least one inner and/or outer actuator arrangement) and the nozzle portion of the nozzle-forming layer are configured such that the inner portion of the nozzle portion curves in a first sense and the outer portion of the nozzle portion curves in a second sense opposite said first sense (i.e. on activation).

Together, the inner and outer portions of the nozzle portion of the nozzle-forming layer (e.g. diaphragm) may form the entire nozzle portion of the nozzle-forming layer (e.g. diaphragm).

It may be that the inner portion is an inner half of the nozzle portion and the outer portion is an outer half of the nozzle portion. A boundary between the inner and outer portions may extend around the fluid chamber outlet approximately 50% of the distance between the fluid chamber outlet and the outer periphery of the nozzle portion.

It may be that the inner portion comprises approximately 50% of the surface area of the nozzle portion. It may be that the outer portion comprises approximately 50% of the surface area of the nozzle portion. It may be that the inner portion comprises less than 50% of the surface area of the nozzle portion and that the outer portion comprises more than 50% of the surface area of the nozzle portion (the areas of the inner and outer portions together typically making up the total surface area of the nozzle portion). It may be that the inner portion comprises approximately 25% of the surface area of the nozzle portion and that the outer portion comprises approximately 75% of the surface area of the nozzle portion (the areas of the inner and outer portions together typically making up the total surface area of the nozzle portion).

The inner and outer portions of the nozzle portion of the nozzle-forming layer (e.g. the diaphragm) may be coaxially arranged. The inner and outer portions of the nozzle portion of the nozzle-forming layer (e.g. the diaphragm) may be concentrically arranged. The inner and outer portions of the nozzle portion of the nozzle-forming layer (e.g. the diaphragm) may be geometrically similar to each other. The inner and outer portions of the nozzle portion of the nozzle-forming layer (e.g. the diaphragm) may each be geometrically similar to the nozzle portion of the nozzle-forming layer (e.g. diaphragm). The inner and outer portions of the nozzle portion of the nozzle-forming layer (e.g. the diaphragm) may be coaxially (e.g. concentrically) arranged around the fluid chamber outlet.

It may be that the inner and outer portions of the nozzle portion of the nozzle-forming layer (e.g. the diaphragm) each extend along approximately 50% of the width (measured in cross-section along a principal axis of the nozzle portion of the nozzle-forming layer (e.g. the diaphragm) in the plane of said nozzle-forming layer (e.g. the diaphragm)) of the nozzle portion of the nozzle-forming layer (e.g. diaphragm). For example, it may be that the nozzle portion of the nozzle-forming layer (e.g. the diaphragm) is substantially circular (e.g. annular), that each of the inner and outer portions of the nozzle-forming layer (e.g. diaphragm) are substantially annular and concentrically arranged, the outer portion extending around the inner portion, the inner portion having an external radius approximately 50% of the external radius of the nozzle portion of the nozzle-forming layer (e.g. the diaphragm) and the outer portion having an internal radius approximately 50% of the external radius of the nozzle portion of the nozzle-forming layer (e.g. the diaphragm) and an external radius approximately equal to the external radius of the nozzle portion of the nozzle-forming layer (e.g. the diaphragm).

The inner actuator arrangement (e.g. the one or more inner actuators), where present, is typically an actuator arrangement (e.g. one or more actuators) formed on the inner portion of the nozzle portion of the nozzle-forming layer (e.g. the diaphragm). The outer actuator arrangement (e.g. the one or more outer actuators), where present, is typically an actuator arrangement (e.g. one or more actuators) formed on the outer portion of the nozzle portion of the nozzle-forming layer (e.g. the diaphragm).

It may be that the droplet ejector comprises only an inner actuator arrangement (e.g. one or more inner actuators) and that the droplet ejector does not comprise an outer actuator arrangement (e.g. one or more outer actuators). That is to say, it may be that the droplet ejector comprises at least one actuator arrangement (e.g. at least one actuator) formed on the inner portion of the nozzle portion of the nozzle-forming layer (e.g. the diaphragm) and that the droplet ejector does not comprise any actuator arrangement (e.g. actuator) formed on the outer portion of the nozzle portion of the nozzle-forming layer (e.g. the diaphragm).

Alternatively, it may be that the droplet ejector comprises only an outer actuator arrangement (e.g. one or more outer actuators) and that the droplet ejector does not comprise an inner actuator arrangement (e.g. one or more inner actuators). That is to say, it may be that the droplet ejector comprises at least one actuator arrangement (e.g. at least one actuator) formed on the outer portion of the nozzle portion of the nozzle-forming layer (e.g. the diaphragm) and that the droplet ejector does not comprise any actuator arrangement (e.g. actuator) formed on the inner portion of the nozzle portion of the nozzle-forming layer (e.g. the diaphragm).

It may be that the inner actuator arrangement (e.g. the one or more inner actuators) is formed on less than 50%, or more typically less than 40%, or more typically less than 30%, of the nozzle portion of the nozzle-forming layer which deforms on actuation.

It may be that the outer actuator arrangement (e.g. the one or more outer actuators) is formed on less than 50%, or more typically less than 40%, or more typically less than 30%, of the nozzle portion of the nozzle-forming layer which deforms on actuation.

The inventor has found that, surprisingly, the provision of only an inner actuator arrangement or only an outer actuator arrangement enables droplet ejection efficiency to be increased compared to known droplet ejectors in which a single actuator arrangement is provided across the majority (e.g. all of) the nozzle portion of the nozzle-forming layer (i.e. overlapping both inner and outer portions of the said nozzle portion of the nozzle-forming layer).

For example, in embodiments in which the droplet ejector comprises only an inner actuator arrangement (e.g. one or more inner actuators), the droplet ejector typically functions, in use, by actuation of the said inner actuator arrangement to drive direct deflection of the inner portion of the nozzle portion of the nozzle-forming layer in a first direction (e.g. first sense). Because the nozzle portion of the nozzle-forming layer is typically fixed in position at its periphery (i.e. outer perimeter), deflection of the inner portion of the nozzle portion of the nozzle-forming layer in the first direction (e.g. first sense) typically causes compensatory deflection of the outer portion of the nozzle portion of the nozzle-forming layer in a second direction (e.g. second sense) opposite the first direction. Deflection of the nozzle portion of the nozzle-forming layer towards (i.e. into) the fluid chamber typically causes ejection of printing fluid from the fluid chamber through the fluid chamber outlet. Because the actuator arrangement is only provided on the inner portion, on actuation the nozzle portion is deformed with greater volumetric deflection (for example, by forming a more complex shape) than is achieved if a single actuator arrangement is provided across the majority (e.g. all of) the nozzle portion of the nozzle-forming layer as is known in the art. In particular, the inventor has found that it is possible to deform the nozzle portion into shapes (and particularly shapes having sigmoidal cross-sections) which permit a much greater ejection force to be exerted than is possible with existing droplet ejectors using similar materials. This increased ejection force enables a more efficient configuration of the actuator (and, for example, the use of individually less powerful actuators than are normally used in inkjet printers and, in the case of piezoelectric droplet ejectors, the use of different piezoelectric materials).

Similarly, in embodiments in which the droplet ejector comprises only an outer actuator arrangement (e.g. one or more outer actuators), geometric constraints ensure that the nozzle portion of the nozzle-forming layer deforms with greater volumetric deflection (for example, by forming more complex shapes) (than are possible using existing devices) on actuation of the outer actuator arrangement.

In alternative embodiments, it may be that the droplet ejector comprises at least one inner actuator arrangement (e.g. one or more inner actuators) and at least one outer actuator arrangement (e.g. one or more outer actuators). That is to say, it may be that the droplet ejector comprises at least one (i.e. inner) actuator arrangement (e.g. one or more actuators) formed on at least a portion (e.g. the inner portion) of the nozzle portion of the nozzle-forming layer (e.g. the diaphragm) and at least one (i.e. outer) actuator arrangement (e.g. one or more actuators) formed on at least a portion (e.g. the outer portion) of the nozzle portion of the nozzle-forming layer (e.g. the diaphragm) at least partially surrounding the inner actuator arrangement.

In embodiments comprising both inner and outer actuator arrangements, actuation of the inner actuator arrangement typically causes deflection of the inner portion of the nozzle portion of the nozzle-forming layer in a first direction (e.g. first sense) and actuation of the outer actuator arrangement typically causes deflection of the outer portion of the nozzle portion of the nozzle-forming layer in a second direction (e.g. second sense), typically opposite said first direction (e.g. first sense). Deflection of both the inner and outer portions of the nozzle portion of the nozzle-forming layer typically causes ejection of printing fluid from the fluid chamber through the fluid chamber outlet. Because the droplet ejector comprises both the inner actuator arrangement and the outer actuator arrangement, it is possible to drive deflection of both the inner and outer portions of the nozzle portion of the nozzle-forming layer (for example, at the same time). Again, the nozzle portion can be deformed with greater volumetric deflection (for example, by forming more complex shapes) than are achievable if only a single actuator arrangement is provided on the nozzle portion of the nozzle-forming layer (and particularly a single actuator arrangement which extends across a majority of the nozzle portion of the nozzle-forming layer, e.g. overlapping both the inner and outer portions of said nozzle portion). In particular, the inventor has found that concurrent actuation of both the inner and outer actuator arrangements can be used to deform the nozzle portion into shapes which permit a greater ejection force to be exerted on the printing fluid. Again, this enables a more efficient configuration of the actuator (and, for example, use of individually less powerful actuators than are normally used in inkjet printers).

It may be that the droplet ejector comprises at least one electronic component integrated with the substrate. The at least one electronic component may comprise at least one active electronic component (e.g. a transistor). Additionally or alternatively, the at least one electronic component may comprise at least one passive electronic component (e.g. a resistor). The at least one electronic component may comprise at least one CMOS (i.e. complementary metal-oxide-semiconductor) electronic component integrated with the substrate.

In embodiments comprising an inner actuator arrangement (i.e. irrespective of the presence or lack of an outer actuator arrangement), the inner actuator arrangement typically at least partially surrounds the fluid chamber outlet. That is to say, the inner actuator arrangement is typically formed on the inner portion of the nozzle portion of the nozzle-forming layer at least partially surrounding the fluid chamber outlet. It may be that the inner actuator arrangement surrounds the fluid chamber outlet. It may be that the inner actuator arrangement completely surrounds the fluid chamber outlet. It may be that the inner actuator arrangement extends continuously around the fluid chamber outlet.

It may be that the inner actuator arrangement consists of a single inner actuator.

It may be that the inner actuator arrangement comprises two or more inner actuators, each of which partially surrounds the fluid chamber outlet. The two or more inner actuators are typically spaced apart from one another. The two or more inner actuators are typically spaced apart from one another around the fluid chamber outlet (i.e. rather than being radially spaced apart from one another). Accordingly, it may be that the inner actuator arrangement extends discontinuously around the fluid chamber outlet.

It may be that the inner actuator arrangement is substantially annular (i.e. ring-shaped). It may be that inner actuator arrangement is centred on the fluid chamber outlet. It may be that the inner actuator arrangement comprises two or more substantially annular inner actuators. It may be that the inner actuator arrangement comprises two or more inner actuators each being partially annular in shape (i.e. each shaped so as to form a portion (e.g. a sector) of an annulus (i.e. a portion of a ring)). It may be that the two or more partially annular inner actuators are centred on (i.e. arranged symmetrically around) the fluid chamber outlet.

By providing the droplet ejector with substantially annular actuator arrangements centred on the fluid chamber outlet, deflection of the nozzle portion of the nozzle-forming layer is typically uniform (i.e. symmetric) around the fluid chamber outlet, resulting in smooth expulsion of droplets from the fluid chamber outlet.

It may be that the inner actuator arrangement is a piezoelectric actuator arrangement, e.g. an inner piezoelectric actuator arrangement.

It may be that the inner actuator arrangement (i.e. the inner piezoelectric actuator arrangement) comprises one or more inner piezoelectric actuators.

At least one of the one or more inner piezoelectric actuators typically comprises a piezoelectric body (i.e. an inner piezoelectric body) provided between a pair of drive electrodes (i.e. an inner pair of drive electrodes).

It may be that each of the one or more inner piezoelectric actuators comprises a piezoelectric body provided between a corresponding pair of drive electrodes (i.e. an inner piezoelectric body provided between a corresponding inner pair of drive electrodes).

It may be that the inner piezoelectric actuator arrangement is substantially annular (i.e. ring-shaped). It may be that the inner piezoelectric actuator arrangement is centred on the fluid chamber outlet.

It may be that the inner actuator arrangement consists of a single inner piezoelectric actuator. It may be that the single inner piezoelectric actuator is substantially annular. It may be that the single inner piezoelectric actuator is centred on the fluid chamber outlet.

It may be that the inner actuator arrangement comprises two or more inner piezoelectric actuators. It may be that the inner actuator arrangement comprises two or more substantially annular inner piezoelectric actuators. It may be that the inner actuator arrangement comprises two or more inner piezoelectric actuators each being partially annular in shape (i.e. each shaped so as to form a portion (e.g. a sector) of an annulus (i.e. a portion of a ring)). It may be that the two or more partially annular inner piezoelectric actuators are centred on (i.e. arranged symmetrically around) the fluid chamber outlet.

It may be that the inner piezoelectric actuators are formed from portions of the same continuous inner piezoelectric body. However, each of the inner piezoelectric actuators typically comprises its own respective pair of inner drive electrodes.

It may be that the inner piezoelectric body does not extend into the outer portion of the nozzle portion of the nozzle-forming layer.

It may be that the nozzle portion of the nozzle-forming layer comprises an inner portion and an outer portion, and an inner piezoelectric actuator arrangement formed on the inner portion, wherein the outer portion has no piezoelectric actuator arrangement formed thereon, wherein actuation of the inner piezoelectric actuator arrangement deforms the inner portion in a first sense (i.e. first direction) by virtue of the forces directly applied to the said inner portion by the said inner piezoelectric actuator arrangement, and wherein the outer portion deforms in a second opposite sense (i.e. second opposite direction) by virtue of being connected to the inner portion and being held around a periphery of said outer portion.

The inner piezoelectric actuator arrangement is typically formed on less than 50%, or more typically less than 40%, or more typically less than 30% of the surface area of the nozzle portion which deforms during operation (i.e. on actuation of said inner piezoelectric actuator arrangement).

It may be that the inner pair of drive electrodes is electrically connected to a drive circuit. The drive circuit is typically configured to selectively apply (i.e. when actuated (e.g. when in use, connected to a power supply (e.g. a voltage signal line) and responsive to an actuation signal)) a potential difference between the inner pair of drive electrodes to cause deflection of the inner piezoelectric body.

It may be that one or more electrodes of the inner pair of drive electrodes are electrically connected to the at least one electronic component integrated with the substrate.

In embodiments comprising an outer actuator arrangement (i.e. irrespective of the presence or lack of an inner actuator arrangement), the outer actuator arrangement typically at least partially surrounds the fluid chamber outlet. That is to say, the outer actuator arrangement is typically formed on the outer portion of the nozzle portion of the nozzle-forming layer at least partially surrounding the fluid chamber outlet.

It may be that the outer actuator arrangement surrounds the fluid chamber outlet. It may be that the outer actuator arrangement completely surrounds the fluid chamber outlet.

It may be that the outer actuator arrangement extends continuously around the fluid chamber outlet.

It may be that the outer actuator arrangement consists of a single outer actuator.

It may be that the outer actuator arrangement comprises two or more outer actuators, each of which partially surrounds the fluid chamber outlet. The two or more outer actuators are typically spaced apart from one another around the fluid chamber outlet (i.e. rather than being radially spaced apart). Accordingly, it may be that the outer actuator arrangement extends discontinuously around the fluid chamber outlet.

It may be that the outer actuator arrangement is substantially annular (i.e. ring-shaped). It may be that outer actuator arrangement is centred on the fluid chamber outlet. It may be that the outer actuator arrangement comprises two or more substantially annular outer actuators. It may be that the outer actuator arrangement comprises two or more outer actuators each being partially annular in shape (i.e. each shaped so as to form a portion (e.g. a sector) of an annulus (i.e. a portion of a ring)). It may be that the two or more partially annular outer actuators are centred on (i.e. arranged symmetrically around) the fluid chamber outlet.

By providing the droplet ejector with substantially annular actuator arrangements centred on the fluid chamber outlet, deflection of the nozzle portion of the nozzle-forming layer is typically uniform (i.e. symmetric) around the fluid chamber outlet, resulting in smooth expulsion of droplets from the fluid chamber outlet.

It may be that the outer actuator arrangement is a piezoelectric actuator arrangement, e.g. an outer piezoelectric actuator arrangement.

It may be that the outer actuator arrangement (i.e. the outer piezoelectric actuator arrangement) comprises one or more outer piezoelectric actuators.

At least one of the one or more outer piezoelectric actuators typically comprises a piezoelectric body (i.e. an outer piezoelectric body) provided between a pair of drive electrodes (i.e. an outer pair of drive electrodes).

It may be that each of the one or more outer piezoelectric actuators comprises a piezoelectric body provided between a corresponding pair of drive electrodes (i.e. an outer piezoelectric body provided between a corresponding outer pair of drive electrodes).

It may be that the outer piezoelectric actuator arrangement is substantially annular (i.e. ring-shaped). It may be that the outer piezoelectric actuator arrangement is centred on the fluid chamber outlet.

It may be that the outer actuator arrangement consists of a single outer piezoelectric actuator. It may be that the single outer piezoelectric actuator is substantially annular. It may be that the single outer piezoelectric actuator is centred on the fluid chamber outlet.

It may be that the outer actuator arrangement comprises two or more outer piezoelectric actuators. It may be that the outer actuator arrangement comprises two or more substantially annular outer piezoelectric actuators. It may be that the outer actuator arrangement comprises two or more outer piezoelectric actuators each being partially annular in shape (i.e. each shaped so as to form a portion (e.g. a sector) of an annulus (i.e. a portion of a ring)). It may be that the two or more partially annular outer piezoelectric actuators are centred on (i.e. arranged symmetrically around) the fluid chamber outlet.

It may be that the outer piezoelectric actuators are formed from portions of the same continuous outer piezoelectric body. However, each of the outer piezoelectric actuators typically comprises its own respective pair of outer drive electrodes.

It may be that the outer piezoelectric body does not extend into the inner portion of the nozzle portion of the nozzle-forming layer.

It may be that the nozzle portion of the nozzle-forming layer comprises an outer portion and an inner portion, and an outer piezoelectric actuator arrangement formed on the outer portion, wherein the inner portion has no piezoelectric actuator arrangement formed thereon, wherein actuation of the outer piezoelectric actuator arrangement deforms the outer portion in a first sense (i.e. first direction) by virtue of the forces directly applied to the said outer portion by the said outer piezoelectric actuator arrangement, and wherein the inner portion deforms in a second opposite sense (i.e. second opposite direction) by virtue of being connected to and retained within the outer portion.

The outer piezoelectric actuator arrangement is typically formed on less than 50%, or more typically less than 40%, or more typically less than 30% of the surface area of the nozzle portion which deforms during operation (i.e. on actuation of said outer piezoelectric actuator arrangement).

It may be that the outer pair of drive electrodes is electrically connected to a drive circuit (e.g. the drive circuit to which the inner pair of drive electrodes is connected, where present). The drive circuit is typically configured to selectively apply (i.e. when actuated (e.g. when in use, connected to a power supply (e.g. a voltage signal line) and responsive to an actuation signal)) a potential difference between the outer pair of drive electrodes to cause deflection of the outer piezoelectric body.

It may be that one or more electrodes of the outer pair of drive electrodes are electrically connected to the at least one electronic component integrated with the substrate.

In embodiments comprising both inner and outer actuator arrangements, the outer actuator arrangement typically at least partially surrounds the inner actuator arrangement. That is to say, the outer actuator arrangement is typically formed on the outer portion of the nozzle portion of the nozzle-forming layer at least partially surrounding the inner actuator arrangement formed on the inner portion of the nozzle portion of the nozzle-forming layer.

It may be that the outer actuator arrangement surrounds the inner actuator arrangement. It may be that the outer actuator arrangement completely surrounds the inner actuator arrangement. It may be that the outer actuator arrangement extends continuously around the inner actuator arrangement.

It may be that the outer actuator arrangement comprises two or more outer actuators, each of which partially surrounds the inner actuator arrangement. The two or more outer actuators are typically spaced apart from one another around the inner actuator arrangement. Accordingly, it may be that the outer actuator arrangement extends discontinuously around the inner actuator arrangement.

The inner actuator arrangement is typically provided closer (i.e. than the outer actuator arrangement) to the fluid chamber outlet (e.g. to a periphery of the fluid chamber outlet) and the outer actuator arrangement is typically provided further away (i.e. than the inner actuator arrangement) from the fluid chamber outlet (e.g. from the periphery of the fluid chamber outlet).

The outer actuator arrangement is typically spaced apart (i.e. radially) from the inner actuator arrangement.

It may be that both the inner and outer actuator arrangements are centred on the fluid chamber outlet. It may be that the inner and outer actuator arrangements are coaxially arranged. It may be that the inner and outer actuator arrangements are co-centric. It may be that both the inner and outer actuator arrangements are formed symmetrically around the fluid chamber outlet. It may be that both the inner and outer actuator arrangements are concentrically arranged.

By providing the droplet ejector with substantially annular actuator arrangements centred on the fluid chamber outlet, deflection of the nozzle portion of the nozzle-forming layer is typically uniform (i.e. symmetric) around the fluid chamber outlet, resulting in smooth expulsion of droplets from the fluid chamber outlet.

It may be that the inner actuator arrangement is a piezoelectric actuator arrangement, e.g. an inner piezoelectric actuator arrangement, and/or the outer actuator arrangement is a piezoelectric actuator arrangement, e.g. an outer piezoelectric actuator arrangement. It will be understood that by referring to the inner actuator arrangement as an inner piezoelectric actuator arrangement, there is no implication that the outer actuator arrangement is necessarily a piezoelectric actuator arrangement (i.e. an outer piezoelectric actuator arrangement). Similarly, it will be understood that by referring to the outer actuator arrangement as an outer piezoelectric actuator arrangement, there is no implication that the inner actuator arrangement is necessarily a piezoelectric actuator arrangement (i.e. an inner piezoelectric actuator arrangement). For example, it may be that one of the inner actuator arrangement and the outer actuator arrangement is a piezoelectric actuator arrangement (i.e. either an inner piezoelectric actuator arrangement or an outer piezoelectric actuator arrangement) and the other of the inner actuator arrangement and the outer actuator arrangement is a non-piezoelectric actuator arrangement (i.e. either an outer non-piezoelectric actuator arrangement or an inner non-piezoelectric actuator arrangement). Alternatively, it may be that both the inner and outer actuator arrangements are piezoelectric actuator arrangements (i.e. an inner piezoelectric actuator arrangement and an outer piezoelectric actuator arrangement).

It may be that the inner actuator arrangement (e.g. the inner piezoelectric actuator arrangement) comprises one or more inner piezoelectric actuators and the outer actuator arrangement (e.g. the outer piezoelectric actuator arrangement) comprises one or more outer piezoelectric actuators. Typically, the one or more outer piezoelectric actuators at least partially surround the one or more inner piezoelectric actuators.

It may be that each of the one or more inner piezoelectric actuators comprises a piezoelectric body provided between a corresponding pair of drive electrodes (i.e. an inner piezoelectric body provided between a corresponding inner pair of drive electrodes). It may be that each of the one or more outer piezoelectric actuators comprises a piezoelectric body provided between a corresponding pair of drive electrodes (i.e. an outer piezoelectric body provided between a corresponding outer pair of drive electrodes). However, it will be understood that by referring to a piezoelectric body of the inner actuator arrangement as an inner piezoelectric body, there is no implication that the outer actuator arrangement necessarily comprises an outer piezoelectric body (e.g. the outer actuator arrangement may be non-piezoelectric). Similarly, it will be understood that by referring to a piezoelectric body of the outer actuator arrangement as an outer piezoelectric body, there is no implication that the inner actuator arrangement necessarily comprises an inner piezoelectric body (e.g. the inner actuator arrangement may be non-piezoelectric).

It may be that both the inner and outer piezoelectric bodies are formed from portions of the same continuous piezoelectric body. Alternatively, it may be that the inner and outer piezoelectric bodies are separate (i.e. not continuous) piezoelectric bodies. It may be that the inner and outer piezoelectric bodies are spaced apart from one another.

It may be that both the inner and outer pairs of drive electrodes are electrically connected to a drive circuit. The drive circuit is typically configured to selectively apply (i.e. when actuated (e.g. when in use, connected to a power supply (e.g. a voltage signal line) and responsive to an actuation signal)) a first potential difference between the inner pair of drive electrodes to cause deflection of the inner piezoelectric body in a first direction and to apply a second potential difference between the outer pair of drive electrodes to cause deflection of the outer piezoelectric body in a second direction opposite said first direction.

The drive circuit may be configured to, when the droplet ejector is in use and connected to a power supply (e.g. a voltage signal line), apply the first potential difference between the inner pair of drive electrodes to cause curvature of the inner piezoelectric body in a first sense and to apply the second potential difference between the outer pair of drive electrodes to cause curvature of the outer piezoelectric body in a second sense opposite said first sense.

The first and second potential differences typically have similar (e.g. the same) magnitudes. The first and second potential differences typically have opposing polarities.

It may be that one or more electrodes of the inner pair of drive electrodes and the outer pair of drive electrodes are electrically connected to the at least one electronic component integrated with the substrate.

It may be that the inner piezoelectric body or bodies (where present) and/or the outer piezoelectric body or bodies (where present) comprise (e.g. are formed from) one or more piezoelectric materials processable at a temperature below 450° C.

Above 300° C., integrated electronic components (e.g. CMOS electronic components) typically begin to degrade, impairing device operation and reducing efficiency. Above 450° C., integrated electronic components (e.g. CMOS electronic components) typically degrade even more substantially. Use of piezoelectric materials processable at a temperature below 450° C. therefore permits processing of, and integration of, piezoelectric actuators with electronic components (e.g. of the drive circuitry) without substantial damage to the said electronic components.

It may be that the inner piezoelectric body or bodies and/or the outer piezoelectric body or bodies comprise (e.g. are formed from) one or more piezoelectric materials processable at a temperature below 300° C. Use of piezoelectric materials processable at a temperature below 300° C. permits processing of, and integration of, piezoelectric actuators with electronic components (e.g. of the drive circuitry) with even less damage to the said electronic components. Use of piezoelectric materials processable at a temperature below 300° C. typically permits a higher yield of functioning devices to be achieved from large-scale manufacture of multiple fluid ejectors on a single substrate (e.g. from a single substrate wafer).

By integrating piezoelectric actuators with electronic components (e.g. drive electronics), the need to provide separate droplet ejector drive electronics (typically provided separate to any piezoelectric printhead microchip in existing devices) is reduced or removed. A large number of droplet ejectors may therefore be closely integrated on one chip, increasing the nozzle count per chip, reducing the overall printhead size, and permitting a higher printhead nozzle density than is achievable with existing piezoelectric printheads. Other benefits associated with integration on a single printhead chip include eventual manufacturing cost reductions, printer system cost reductions, modularity, device reliability and printer system improvements such as improved redundancy and throughput.

Piezoelectric materials which are processable below 450° C. (or below 300° C.) typically have poorer piezoelectric properties (e.g. lower piezoelectric constants) than piezoelectric materials which require processing at higher temperatures. For example, a piezoelectric actuator formed from a high-temperature processable piezoelectric material such as lead zirconate titanate (PZT) is able to exert a force over an order of magnitude greater than a piezoelectric actuator formed from a low-temperature processable piezoelectric material such as aluminium nitride (AlN), all other factors being equal.

However, the inventor has found that, by providing an inner piezoelectric actuator arrangement and/or an outer piezoelectric actuator arrangement, the droplet ejection efficiency of the droplet ejector may be improved (in particular when compared to the provision of piezoelectric actuators on a fluid chamber wall further away from the fluid chamber outlet, as is found in existing piezoelectric droplet ejectors) sufficiently that use of low-temperature processable piezoelectric materials becomes feasible. It is the particular structure of the droplet ejector in the present invention which enables the use of low-temperature processable piezoelectric materials, which itself then permits integration of the droplet ejector with drive electronics.

In particular, application of an electric field (i.e. potential difference) between the inner pair or pairs of drive electrodes typically induces deformation of the inner piezoelectric actuator or actuators and application of an electric field (i.e. potential difference) between the outer pair or pairs of drive electrodes typically induces deformation of the outer piezoelectric actuator or actuators, each causing a highly damped oscillation of the nozzle-portion of the nozzle-forming layer. Oscillation of the nozzle-portion of the nozzle-forming layer sets up an oscillating pressure field within the fluid chamber, driving ejection of a droplet through the fluid chamber outlet. By displacing the nozzle portion of the nozzle-forming layer (rather than displacing a fluid chamber wall provided further away from the fluid chamber outlet), relatively small fluid pressures, and thus relatively small actuation forces, are required to eject a droplet of fluid, thereby facilitating use of low-temperature processable piezoelectric materials having lower piezoelectric constants.

Because the force exerted by piezoelectric actuators comprising low-temperature processable piezoelectric materials is relatively low (compared to devices using piezoelectric actuators comprising high-temperature processable piezoelectric materials), and thus because relatively low fluid pressures are achieved, acoustic cross talk (by way of acoustic waves propagating through the printhead) between neighbouring fluid chambers on a printhead is reduced. The lower pressures reduce fluidic compressibility, making acoustic cross talk less likely. Lower levels of acoustic cross talk permit even closer integration of neighbouring droplet ejectors on a printhead without a reduction in print quality.

Processing of a piezoelectric material typically comprises deposition of said piezoelectric material. Processing of a piezoelectric material may also comprise further processing of the piezoelectric material after deposition (i.e. post-deposition processing, or 'post-processing', of the deposited piezoelectric material). Processing of a piezoelectric material may comprise (i.e. post-deposition) annealing of the piezoelectric material.

A piezoelectric material processable at a temperature below 450° C. (or below 300° C.) is typically a piezoelectric material which is depositable at a temperature below 450° C. (or below 300° C.). A piezoelectric material processable at a temperature below 450° C. (or below 300° C.) does not typically require any post-deposition processing (such as post-deposition annealing) at a temperature at or above 450° C. (or at or above 300° C.). A piezoelectric material processable at a temperature below 450° C. (or below 300° C.) is therefore typically a piezoelectric material which is annealable (after deposition) at a temperature below 450° C. (or below 300° C.) (i.e. if annealing of the piezoelectric material is required to render the piezoelectric body piezoelectric).

The one or more piezoelectric materials are typically processable (e.g. depositable and, if required, annealable) at a temperature below 450° C. (or below 300° C.) such that the piezoelectric actuators are manufacturable at a temperature below 450° C. (or below 300° C.). Manufacture of the piezoelectric actuators at a temperature below 450° C. (or below 300° C.) typically permits integration of the piezoelectric actuators with the at least one electronic component integrated with the substrate.

The inner piezoelectric body or bodies and/or the outer piezoelectric body or bodies are therefore typically formable (e.g. by deposition and, if required, annealing of the one or more piezoelectric materials) at a temperature below 450° C. (or below 300° C.).

The one or more piezoelectric materials are typically processable (e.g. depositable and, if required, annealable) at a substrate temperature below 450° C. (or below 300° C.). In other words, the temperature of the substrate does not typically reach or exceed 450° C. (or 300° C.) during processing (e.g. deposition and, if required, annealing) of the one or more piezoelectric materials. The temperature of the substrate does not typically reach or exceed 450° C. (or 300° C.) during formation of the piezoelectric bodies. The temperature of the substrate does not typically reach or exceed 450° C. (or 300° C.) during manufacture of the piezoelectric actuators. It may be that the temperature of the substrate does not reach or exceed 450° C. (or 300° C.) during manufacture of the (e.g. entire) droplet ejector.

The inner piezoelectric body or bodies and/or the outer piezoelectric body or bodies are typically depositable (e.g. deposited) by one or more (e.g. low-temperature) physical vapour deposition (PVD) methods. The inner piezoelectric body or bodies and/or the outer piezoelectric body or bodies are typically depositable (e.g. deposited) by one or more (e.g. low-temperature) physical vapour deposition methods at a temperature (i.e. at a substrate temperature) below 450° C. (or more preferably below 300° C.).

It may be that inner piezoelectric body or bodies and/or the outer piezoelectric body or bodies comprise (e.g. are formed from) one or more (e.g. low-temperature) PVD-depositable piezoelectric materials. It may be that inner piezoelectric body or bodies and/or the outer piezoelectric body or bodies comprise (e.g. are formed from) one or more (e.g. low-temperature) PVD-deposited piezoelectric materials.

Physical vapour deposition methods (e.g. low-temperature physical vapour deposition methods) may comprise one or more of the following deposition methods: cathodic arc deposition, electron beam physical vapour deposition, evaporative deposition, pulsed laser deposition, sputter deposition. Sputter deposition may comprise sputtering of material from single or multiple sputtering targets.

The one or more piezoelectric materials typically have deposition temperatures below 450° C. (or below 300° C.). The one or more piezoelectric materials may have PVD-deposition temperatures below 450° C. (or below 300° C.). The one or more piezoelectric materials may have sputtering temperatures below 450° C. (or below 300° C.). The one or more piezoelectric materials may have post-deposition annealing temperatures below 450° C. (or below 300° C.). It will be understood that the deposition temperature, the PVD-deposition temperature, the sputtering temperature or the annealing temperature is typically the temperature of the substrate during the respective process.

The inner piezoelectric body or bodies and/or the outer piezoelectric body or bodies may comprise (e.g. be formed from) one piezoelectric material. Alternatively, the inner piezoelectric body or bodies and/or the outer piezoelectric body or bodies may comprise (e.g. be formed from) more than one piezoelectric material.

The inner piezoelectric body or bodies and/or the outer piezoelectric body or bodies may comprise (e.g. be formed from) a ceramic material comprising aluminium and nitrogen and optionally one or more elements selected from: scandium, yttrium, titanium, magnesium, hafnium, zirconium, tin, chromium, boron.

The inner piezoelectric body or bodies and/or the outer piezoelectric body or bodies may comprise (e.g. be formed from) aluminium nitride (AlN).

The inner piezoelectric body or bodies and/or the outer piezoelectric body or bodies may comprise (e.g. be formed from) zinc oxide (ZnO).

The one or more piezoelectric materials may comprise (e.g. consist of) aluminium nitride and/or zinc oxide.

Aluminium nitride may consist of pure aluminium nitride. Alternatively, aluminium nitride may comprise one or more other elements (i.e. aluminium nitride may comprise aluminium nitride compounds). Aluminium nitride may comprise one or more of the following elements: scandium, yttrium, titanium, magnesium, hafnium, zirconium, tin, chromium, boron.

The inner piezoelectric body or bodies and/or the outer piezoelectric body or bodies may comprise (e.g. be formed from) scandium aluminium nitride (ScAlN). The percentage of scandium in scandium aluminium nitride is typically chosen to optimize the $d_{31}$ piezoelectric constant within the limits of manufacturability. For example, the value of x in $Sc_xAl_{1-x}N$ is typically chosen from the range $0<x\leq 0.5$. Greater fractions of scandium typically result in larger values of $d_{31}$ (i.e. stronger piezoelectric effects). The mass percentage (i.e. the weight percentage) of scandium in scandium aluminium nitride is typically greater than 5%. The mass percentage (i.e. the weight percentage) of scandium in scandium aluminium nitride is typically greater than 10%. The mass percentage (i.e. the weight percentage) of scandium in scandium aluminium nitride is typically greater than 20%. The mass percentage (i.e. the weight percentage) of scandium in scandium aluminium nitride is typically greater than 30%. The mass percentage (i.e. the weight percentage) of scandium in scandium aluminium nitride is typically greater than 40%. The mass percentage (i.e. the weight percentage) of scandium in scandium aluminium nitride may be less than or equal to 50%.

Aluminium nitride, including aluminium nitride compounds (and in particular scandium aluminium nitride), and zinc oxide are piezoelectric materials which may be deposited below 450° C., or more preferably below 300° C. Aluminium nitride, including aluminium nitride compounds (and in particular scandium aluminium nitride), and zinc oxide are piezoelectric materials which may be deposited by physical vapour deposition (e.g. sputtering) below 450° C., or more preferably below 300° C. Aluminium nitride, including aluminium nitride compounds (and in particular scandium aluminium nitride), and zinc oxide are piezoelectric materials which do not typically require annealing after deposition.

The inner piezoelectric body or bodies and/or the outer piezoelectric body or bodies may comprise (e.g. be formed from) aluminium nitride (e.g. aluminium nitride compounds, for example scandium aluminium nitride) and/or zinc oxide deposited by physical vapour deposition below 450° C., or more preferably below 300° C. The inner piezoelectric body or bodies and/or the outer piezoelectric body or bodies may comprise (e.g. be formed from) one or more III-V and/or II-VI semiconductors (i.e. compound semiconductors comprising elements from Groups III and V and/or Groups II and VI of the Periodic Table). Such III-V and II-VI semiconductors typically crystallise in the hexagonal wurtzite crystal structure. III-V and II-VI semiconductors crystallising in the hexagonal wurtzite crystal structure are typically piezoelectric due to their non-centrosymmetric crystal structure.

The inner piezoelectric body or bodies and/or the outer piezoelectric body or bodies may comprise (e.g. be formed from or consist of) non-ferroelectric piezoelectric materials. The one or more piezoelectric materials may be one or more non-ferroelectric piezoelectric materials. Ferroelectric materials typically require (i.e. post-deposition) poling under strong applied electric fields. Non-ferroelectric piezoelectric materials typically do not require poling.

The inner piezoelectric body or bodies and/or the outer piezoelectric body or bodies typically have a piezoelectric constant $d_{31}$ having a magnitude less than 30 pC/N, or more typically less than 20 pC/N, or even more typically less than 10 pC/N. The one or more piezoelectric materials typically have piezoelectric constants $d_{31}$ having magnitudes less than 30 pC/N, or more typically less than 20 pC/N, or even more typically less than 10 pC/N.

The one or more piezoelectric materials are typically CMOS-compatible. By this, it will be understood that the one or more piezoelectric materials do not typically comprise, or are typically processable (e.g. depositable, and if required, annealable) without use of, substances which damage CMOS electronic structures. For example, processing (e.g. deposition, and if required, annealing) of the one or more piezoelectric materials does not typically include use of (e.g. strong) acids (such as hydrochloric acid) and/or (e.g. strong) alkalis (such as potassium hydroxide).

It may be that the nozzle-forming layer comprises a nozzle plate. The nozzle plate may consist of a single layer of material. Alternatively, the nozzle plate may consist of a laminate structure of two or more layers of (e.g. different) material. The nozzle plate is typically formed from one or more materials each having a Young's modulus (i.e. tensile elastic modulus) of between 70 GPa and 300 GPa. The nozzle plate may be formed from one or more of: silicon dioxide ($SiO_2$), silicon nitride ($Si_3N_4$), silicon carbide (SiC), silicon oxynitride ($SiO_xN_y$).

It may be that the nozzle-forming layer comprises an electrical interconnect layer. The electrical interconnect layer typically comprises one or more electrical connections (e.g. electrical wiring) typically surrounded by electrical insulator. The one or more electrical connections (e.g. electrical wiring) are typically formed from a metal or metal alloy. Suitable metals include aluminium, copper and tungsten, and alloys thereof. The electrical insulator is typically formed from a dielectric material such as silicon dioxide ($SiO_2$), silicon nitride ($Si_3N_4$) or silicon oxynitride ($SiO_xN_y$).

It may be that the electrical interconnect layer is provided (e.g. formed) between the substrate and the nozzle plate. It may be that the electrical interconnect layer is provided (e.g. formed) on the second surface of the substrate, and the nozzle-plate is provided (e.g. formed) on the electrical interconnect layer. The nozzle-plate may comprise one or more apertures through which electrical connections to the electrical interconnect layer may be formed.

It may be that a nozzle portion of the electrical interconnect layer forms at least a part of the nozzle portion of the nozzle-forming layer. It may be that the nozzle portion of the electrical interconnect layer consists of dielectric material. Alternatively, it maybe that the electrical interconnect layer does not form part of the nozzle portion of the nozzle-forming layer.

The inner and outer pairs of drive electrodes typically comprise one or more layers of metal (such as titanium, platinum, aluminium, tungsten, molybdenum or alloys thereof). The inner and outer pairs of drive electrodes may be laminated. For example, the inner and outer pairs of drive electrodes may be formed from an aluminium-molybdenum (Al/Mb) laminated stack. The inner and outer pairs of drive electrodes are typically deposited by (e.g. low-temperature) PVD at a temperature (i.e. at a substrate temperature) below 450° C. (or more typically below 300° C.).

It may be that one or more of the inner and outer pairs of drive electrodes is electrically connected to the at least one electronic component. It may be that each of the inner and outer pairs of drive electrodes are electrically connected to the at least one electronic component.

The droplet ejector may comprise the drive circuitry. Alternatively, the drive circuitry may form part of a printhead comprising the droplet ejector. The drive circuitry typically generates the potential differences required to operate the inner and outer actuator arrangements.

The droplet ejector may comprise control circuitry. Alternatively, the control circuitry may form part of a printhead comprising the droplet ejector. The control circuitry typically determines when to operate the drive circuitry.

In embodiments in which the droplet ejector comprises the drive circuitry, the said drive circuitry is typically integrated with the substrate. The at least one electronic component typically forms part of the drive circuitry. It may be that one or more of the inner and/or outer pairs of drive electrodes is connected electrically to the drive circuitry. It may be that each of the inner and outer pairs of drive electrodes are electrically connected to the drive circuitry.

It may be that the at least one electronic component is configured to provide a (e.g. variable) potential difference (i.e. a voltage) between the inner pair or pairs of drive electrodes, where present (i.e. in use). It may be that the at least one electronic component is configured to vary the potential difference (i.e. voltage) between the inner pair or pairs of drive electrodes (i.e. in use).

It may be that the at least one electronic component is configured to provide a (e.g. variable) potential difference (i.e. a voltage) between the outer pair or pairs of drive electrodes, where present (i.e. in use). It may be that the at least one electronic component is configured to vary the potential difference (i.e. voltage) between the outer pair or pairs of drive electrodes (i.e. in use).

It may be that the at least one electronic component is configured to provide a first potential difference between the inner pair or pairs of drive electrodes and a second potential difference between the outer pair or pair of drive electrodes. It may be that the at least one electronic component is configured to provide said first and second potential differences concurrently. The first and second potential differences are typically similar (e.g. the same) in magnitude. The first and second potential differences typically have opposing polarities.

The drive circuitry may comprise CMOS circuitry (e.g. CMOS electronics) integrated with the substrate. CMOS electronic components (e.g. CMOS electronic components forming part of CMOS circuitry, i.e. CMOS electronics) are typically formed (e.g. grown) on the substrate by way of standard CMOS manufacturing methods. For example, integrated CMOS electronic components may be deposited by way of one or more of the following methods: physical vapour deposition, chemical vapour deposition, electrochemical deposition, molecular beam epitaxy, atomic layer deposition, ion implantation, photopatterning, reactive ion etching, plasma exposure.

It may be that the droplet ejector further comprises a protective layer covering the inner and outer actuator arrangements and the nozzle-forming layer. The protective layer is typically chemically inert, impermeable and/or fluid-repellent. The protective layer should have a low Young's modulus (i.e. tensile elastic modulus). The protective layer should have a Young's modulus which is substantially smaller than the Young's modulus of the nozzle-forming layer (and in particular the nozzle-plate) and/or the piezoelectric bodies. The protective layer typically has a Young's modulus less than 50 GPa. The protective layer may be formed from one or more polymeric materials such as polyimides or polytetrafluoroethylene (PTFE), diamond-like carbon (DLC), negative or positive based photoresists, or epoxy-based photoresists (such as Su-8, BCB), or any combination thereof. The protective layer may comprise two or more layers of such different materials having different fluid wetting characteristics.

The droplet ejector is typically monolithic. The droplet ejector is typically integrated (i.e. an integrated droplet ejector). The substrate, nozzle-forming layer, actuator arrangements, fluid chamber, the at least one electronic component (e.g. of the drive electronics) and the protective layer are typically integrated (i.e. with one another). The droplet ejector is typically manufactured by integrally forming the substrate, nozzle-forming layer, actuator arrangements, the at least one electronic component (e.g. of the drive electronics) and the protective layer through one or more deposition processes. The droplet ejector is not typically manufactured by bonding together one or more individually-formed components (e.g. individually-formed substrates, nozzle-forming layers, actuator arrangements, electronic components and/or protective layers).

It may be that the mounting surface of the substrate comprises a fluid inlet aperture in fluid communication with the fluid chamber.

The fluid chamber may be substantially elongate. The fluid chamber typically extends from the mounting surface of the substrate to the nozzle surface. The fluid chamber typically extends along a direction substantially perpendicular to the mounting surface and/or the nozzle surface. The fluid chamber typically extends between the fluid inlet aperture and the fluid chamber outlet.

The fluid chamber may be substantially circular in cross-section through the plane of the substrate. The fluid chamber may be substantially polygonal in cross-section through the plane of the substrate (for example, the fluid chamber may be substantially square in cross-section). The fluid chamber may be many-sided in cross-section through the plane of the substrate.

The fluid chamber may be substantially prismatic in shape. A longitudinal axis of the substantially prismatic fluid chamber typically extends along the direction substantially perpendicular to the mounting surface and/or the nozzle surface.

The fluid chamber may be substantially cylindrical in shape. A longitudinal axis of the substantially cylindrical chamber typically extends along the direction substantially perpendicular to the mounting surface and/or the nozzle surface.

The nozzle portion of the nozzle-forming layer is typically the portion of the nozzle-forming layer which extends across the fluid chamber, thereby forming at least one wall of the fluid chamber.

The nozzle portion of the nozzle-forming layer typically protrudes beyond the substrate and is therefore bendable independently of the substrate.

It may be that the nozzle portion of the nozzle-forming layer is substantially annular.

It may be that the fluid chamber is substantially cylindrical and the nozzle portion of the nozzle-forming layer is substantially annular.

The fluid chamber is typically bounded by one or more fluid chamber walls. At least one of the one or more fluid chamber walls are typically formed by a portion of the substrate. At least one of the one or more fluid chamber walls typically extend substantially perpendicular (i.e. orthogonal) to the mounting surface and/or nozzle surface of said substrate. Perpendicular (i.e. orthogonal) fluid chamber walls typically permit closer packing of multiple adjacent fluid chambers (and thus droplet ejectors) onto a single printhead, thereby increasing nozzle density. Perpendicular (i.e. orthogonal) fluid chamber walls are typically formed by deep reactive-ion etching (DRIE) methods, such as using the Bosch process.

It may be that the perimeter of the nozzle portion of the nozzle-forming layer is substantially polygonal. It may be that the perimeter of the nozzle portion of the nozzle-forming layer is many-sided. The nozzle portion of the nozzle-forming layer may be lozenge-shaped. The nozzle portion of the nozzle-forming layer may be square-shaped. Nevertheless, it may be that the nozzle portion of the nozzle-forming layer (e.g. the polygonal, many-sided lozenge-shaped and/or square-shaped nozzle portion of the nozzle-forming layer) may have rounded corners. The nozzle portion of the nozzle-forming layer typically comprises an aperture. The aperture may be substantially circular. The aperture may be substantially polygonal. The aperture may be many-sided.

It may be that the fluid chamber is shaped in cross-section in the plane of the substrate substantially similarly to the shape of the nozzle portion of the nozzle-forming layer. For example, it may be that where the nozzle portion of the nozzle-forming layer is square-shaped with rounded corners, the fluid chamber may be square-shaped with rounded corners in cross-section.

It may be that the nozzle portion of the nozzle-forming layer (i.e. the portion of the nozzle-forming layer which extends across the fluid chamber, thereby forming at least one wall of the fluid chamber) is shaped substantially similarly to the shape of the fluid chamber in cross-section in the plane of the substrate. For example, where the fluid chamber is substantially cylindrical (i.e. substantially circular in cross section), the perimeter of the nozzle portion of the nozzle-forming layer is substantially circular.

The printhead may be an inkjet printhead. The droplet ejector may be a droplet ejector for (e.g. configured for use in) an inkjet printhead. The droplet ejector may be an inkjet droplet ejector.

The printhead may be configured to print fluids (i.e. liquids), such as functional fluids, for use in the manufacture of printed electronics.

The printhead may be configured to print biological fluids. Biological fluids typically comprise biological macromolecules, e.g. polynucleotides, such as DNA or RNA, microorganisms, and/or enzymes. The printhead may be configured to print other fluids used in biological or biotechnological applications, such as diluents or reagents.

The printhead may be a voxel printhead (i.e. a printhead configured for use in 3D printing, e.g. additive printing).

A second aspect of the invention provides a printhead comprising a plurality of droplet ejectors according to the first aspect of the invention. It may be that (e.g. some or each of) the plurality of droplet ejectors share a common substrate. For example, it may be that the plurality of droplet ejectors are integrated on said common substrate.

The printhead may be an inkjet printhead. Each of the plurality of droplet ejectors may be an inkjet droplet ejector.

The printhead may be configured to print functional fluids, such as for use in the manufacture of printed electronics.

The printhead may be configured to print biological fluids. Biological fluids typically comprise biological macromolecules, e.g. polynucleotides, such as DNA or RNA, microorganisms, and/or enzymes. The printhead may be configured to print other fluids used in biological or biotechnological applications, such as diluents or reagents.

The printhead may be a voxel printhead (i.e. a printhead configured for use in 3D printing, e.g. additive printing).

A third aspect of the invention provides a printer comprising one or more printheads according the second aspect of the invention.

A fourth aspect of the invention provides a method of actuating a droplet ejector according to the first aspect of the invention. The method typically comprises actuating the inner actuator arrangement and/or actuating the outer actuator arrangement to thereby cause displacement of at least a portion of the nozzle portion of the nozzle-forming layer and consequently ejection of fluid from the fluid chamber through the fluid chamber outlet.

It may be that the droplet ejector comprises an inner actuator arrangement and an outer actuator arrangement (i.e. the method is a method of actuating a droplet ejector comprising: a substrate having a mounting surface and an opposite nozzle surface; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the said nozzle-forming layer; an inner actuator arrangement formed on at least a portion of the nozzle portion of the nozzle-forming layer; and an outer actuator arrangement formed on at least a portion of the nozzle portion of the nozzle-forming layer at least partially surrounding the inner actuator arrangement).

It may be that the method comprises actuating both the inner actuator arrangement and the outer actuator arrangement. Actuation of both the inner actuator arrangement and the outer actuator arrangement typically causes deflection of at least a portion of the nozzle portion of the nozzle-forming layer and consequently ejection of fluid from the fluid chamber through the fluid chamber outlet (i.e. when fluid is stored in the fluid chamber). The method therefore typically comprises providing fluid (i.e. liquid) in the fluid chamber.

The steps of actuating the inner actuator arrangement and actuating the outer actuator arrangement typically take place concurrently (i.e. at the same time).

The drive circuitry typically actuates both the inner actuator arrangement and the outer actuator arrangement.

In embodiments in which the inner actuator arrangement comprises one or more inner piezoelectric actuators, it may be that the method comprises applying a first potential difference (i.e. voltage) between the inner pair or pairs of drive electrodes to cause deflection of the inner piezoelectric body or bodies. In embodiments in which the outer actuator arrangement comprises one or more outer piezoelectric actuators, it may be that the method comprises applying a second potential difference (i.e. voltage) between the outer pair or pairs of drive electrodes to cause deflection of the outer piezoelectric body or bodies. It may be that method comprises applying the first and second potential differences concurrently (i.e. at the same time). The drive circuitry typically applies the first and second potential differences.

It may be that the first and second potential differences have similar (e.g. the same) magnitudes. It may be that the first and second potential differences have opposing polarities. Application of first and second potential differences having opposing polarities typically results in deflection of the inner and outer piezoelectric bodies in opposing directions.

It may be that the method comprises: first, actuating the inner actuator arrangement and the outer actuator arrangement (e.g. concurrently) to cause deflection of at least a portion of the nozzle portion of the nozzle-forming layer in a first direction; and, second, actuating the inner actuator arrangement and the outer actuator arrangement (e.g. concurrently) to cause deflection of at least a portion of the nozzle portion of the nozzle-forming layer in a second direction opposite said first direction. Deflection of the nozzle-forming layer in the first direction typically causes fluid to be drawn into the fluid chamber, while deflection of the nozzle-forming layer in the second direction typically causes ejection of fluid from the fluid chamber through the fluid chamber outlet. Deflection of the nozzle-forming layer in the first direction before deflection in the second direction also typically permits a greater ejection force to be exerted on the fluid by displacement of the nozzle-portion through a greater distance on ejection.

Optional or preferred features of any one aspect of the invention may be optional or preferred features of any other aspect of the invention.

DESCRIPTION OF THE DRAWINGS

An example embodiment of the present invention will now be illustrated with reference to the following Figures in which:

FIG. 19 shows a table listing some common piezoelectric materials and the manufacturing methods associated with them, along with typical $d_{31}$ values.

DETAILED DESCRIPTION OF AN EXAMPLE EMBODIMENT

First Example Embodiment

The first example embodiment is described with reference to FIGS. 1 to 5 and FIGS. 10 and 11.

Figure 1:
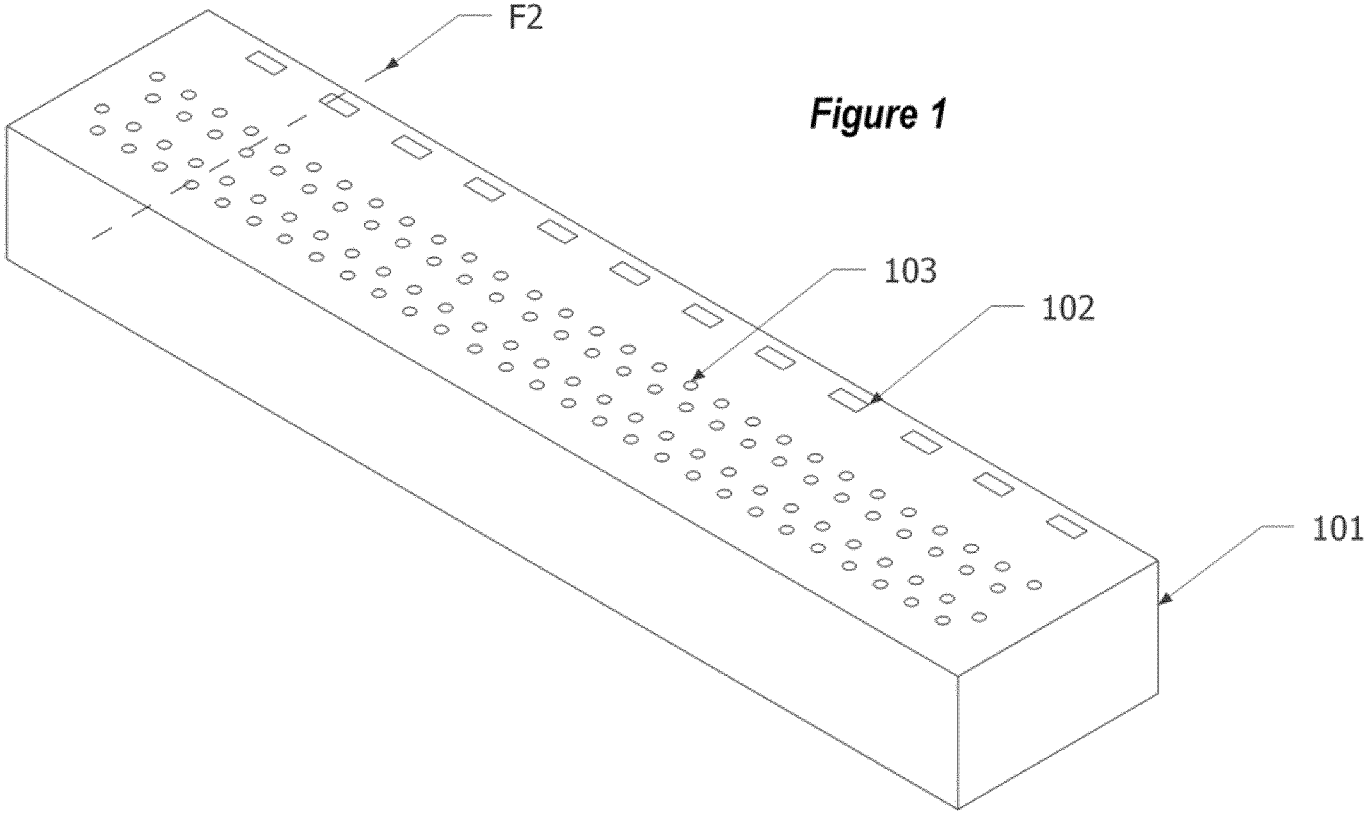
FIG. 1 is a view of a monolithic fluid droplet ejector device including integrated fluidics, electronic circuitry, nozzles and actuators according to a first embodiment.
Figure 2:
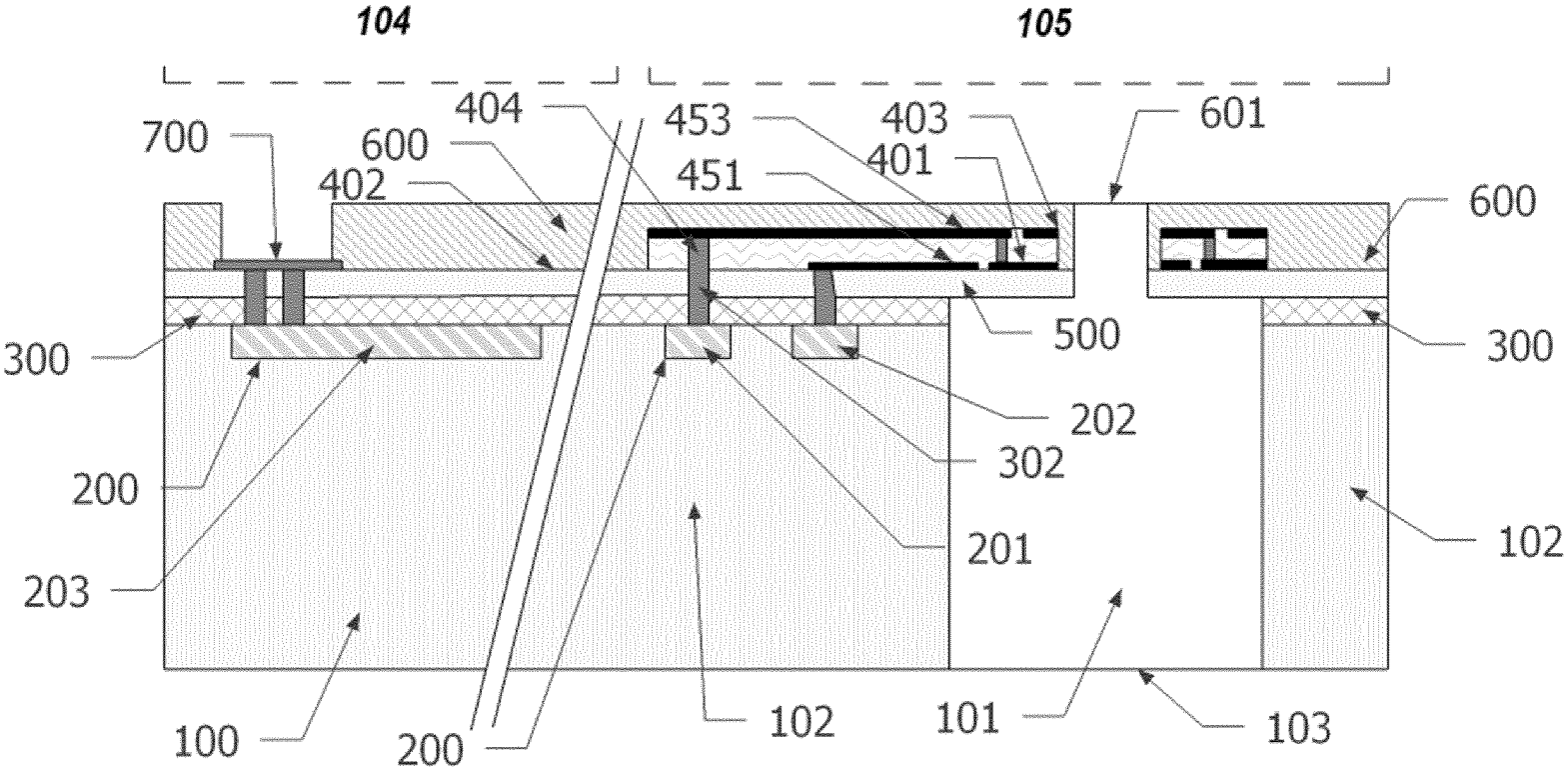
FIG. 2 is a cross-sectional view of the monolithic droplet ejector device along the line F2 shown in FIG. 1.

FIG. 1 shows a monolithic fluid droplet ejector device 1 including integrated fluidics, electronic circuitry, nozzles and actuators according to the first example embodiment of the invention. FIG. 2 is a cross sectional view of the monolithic droplet ejector device 1 along the line F2 shown in FIG. 1.

As shown in FIG. 1 and FIG. 2, the fluid droplet ejector device is a monolithic chip that includes a substrate 100, fluid inlet channel 101, electronic circuitry 200, interconnect layer 300 comprising wiring, inner piezoelectric actuator 400, outer piezoelectric actuator 450, nozzle plate 500, protective front surface 600, nozzle 601 and bond pad 700. FIG. 1 shows a bond pad region 102 and a nozzle region 103.

The substrate 100 is typically between 20 and 1000 micrometres in thickness. The interconnect layer 300, inner piezoelectric actuator 400, outer piezoelectric actuator 450, nozzle plate 500 and protective front surface 600 are typically between 0.5 and 5 micrometres in thickness. The nozzle 601 is typically between 3 and 50 micrometres in diameter. The fluid inlet channel 103 has a characteristic dimension of between 50 and 800 micrometres.

The monolithic chip shown in FIG. 1 comprises 4 rows of nozzles. Each row is offset relative to adjacent rows in an alternating pattern. Any number of nozzle rows in different configurations are possible. The arrangement of the nozzles on the chip is configured to achieve a target print density (i.e. number of dots per inch (dpi)), a target firing frequency and/or a target print speed. A range of different nozzle configurations are possible which satisfy the particular printing requirements. Different printhead nozzle configurations are effected by arranging individual nozzle and nozzle specific drive electronics 201 and 202.

The substrate 100 is formed from a silicon wafer and comprises a supporting body 102, fluid inlet channels 101 and electronic circuitry 200.

The fluid inlet channels 101 are formed through the thickness of the substrate 100 with an opening at one surface at a fluid inlet 103 and are terminated at the other end by the nozzle plate 500 and nozzles 601. The walls of the fluid inlet channels 101 have a similar cross section through the substrate 100 and interconnect layer 300. The fluid inlet channels 101 are substantially cylindrical (i.e. substantially circular in cross section in the plane of the substrate). The corners of the fluid inlet channels 101, at the interface with the nozzle plate and at the fluid inlet interface, are rounded to minimize stress concentrations.

The electronic circuitry 200 is formed on the opposite surface of the substrate 100 to the surface that includes the fluid inlets 103. The electronic circuitry 200 can include digital and/or analog circuitry. Portions of the electronic circuitry, 201 and 202, are connected directly to the inner and outer piezoelectric actuators 400 and 450 by way of wiring 301 and 302 through the interconnect layer 300 and are located close to the actuators 400 and 450 to optimize the application of a drive wave form. The electrode actuator wiring interconnects 301 and 302 may be a continuous single construction or they may be constructed from multiple layers of wiring. The drive electronics may be configured to apply a set voltage or shaped voltage to the piezoelectric actuators for a set period of time.

Portions of the electronic circuitry 203 are associated with the overall operation of the entire monolithic droplet ejector device and can be located separate to the actuator drive circuitry 201 and 202. The circuitry 203 associated with the general operation of the chip can perform a range of functionalities including data routing, authentication, chip monitoring (e.g. chip temperature monitoring), lifecycle management, yield information processing and/or dead nozzle monitoring. The circuitry 203 is connected to the bond pads 700 and the specific electrode drive circuitry 201 and 202 through the interconnect layer 300. The chip drive electronics 203 may include analog and/or digital circuits configured to perform different functions such as data caching, data routing, bus management, general logic, synchronization, security, authentication, power routing and/or input/output. The chip drive electronics 203 may comprise circuitry components such as timing circuitry, interface circuitry, sensors and/or clocks.

There may be a number of general drive electronics areas located in different sections of the chip—for example between nozzle rows or around the periphery of the chip.

The electronic drive circuitry includes 200 CMOS drive circuitry.

The interconnect layer 300 is formed directly on top of the electronics circuitry 200 and the substrate 100 and comprises electrical insulator and wiring. Wiring in the interconnect layer 300 connects chip electronic circuitry 203 to both the bond pads 700 and to the actuator electrode drive circuitry 201 and 202. The interconnect layer 300 includes power and data routing wiring which is routed between nozzles, around the periphery of the chip and/or over drive electronics. The interconnect layer 300 typically comprises multiple layers having different wiring paths.

A nozzle plate 500 is formed on top of the interconnect layer 300. The nozzle plate 500 is formed from either a single material or a laminate of multiple materials. The nozzle plate 500 is continuous across the front surface of the chip with electrical openings for wiring between the interconnect layer 300 below and actuator electrodes 401 above.

The nozzle plate 500 is formed from one or more materials which must be manufacturable with the CMOS electronic drive circuitry 200 in terms of deposition temperatures, compositions, and chemical processing steps. The nozzle plate materials must also be chemically stable and impervious to the jetted fluids. The nozzle plate materials must also be compatible with the functioning of the piezoelectric actuator. For example, the Young's modulus of suitable materials lies in the range of 70 GPa to 300 GPa. However, variations in Young's modulus can be accommodated by changing the thickness of the nozzle plate 500. Example nozzle plate materials include one or more of (e.g. including combinations and/or laminates of) silicon dioxide ($SiO_2$), silicon nitride ($Si_3N_4$), silicon carbide (SiC) and silicon oxynitride ($SiO_xN_y$).

Each outer piezoelectric actuator 450 comprises a laminate of a first electrode 451, a piezoelectric layer 452 and a second electrode 453. The first electrode 451 is attached to the nozzle plate 500. The piezoelectric layer 452 is attached to the first electrode 451. The second electrode 403 is attached to the piezoelectric layer surface opposite the first electrode attachment surface. The first electrode 451 is electrically connected to a wiring connection 301 in the interconnect layer 300. The second electrode 453 is electrically connected to a wiring connection 302 in the interconnect layer 300. The first electrode 451 and second electrode 453 are electrically isolated from each other.

Each inner piezoelectric actuator 400 comprises a laminate of a first electrode 401, a piezoelectric layer 402 and a second electrode 403. The first electrode 401 is attached to the nozzle plate 500. The piezoelectric layer 402 is attached to the first electrode 401. The second electrode 403 is attached to the piezoelectric layer surface opposite the first electrode attachment surface. The first electrode 401 is electrically connected to the second electrode 453 of the outer piezoelectric actuator. The second electrode 403 is electrically connected to the first electrode 451 of the outer piezoelectric actuator. The first electrode 401 and second electrode 403 of the inner piezoelectric actuator are electrically isolated from each other.

The electrode materials are electrically conductive and are typically formed from metals or intermetallic compounds such as titanium (Ti), aluminium (Al), titanium-aluminide (TiAL), tungsten (W) or platinum (Pt), or alloys thereof. These materials are manufacturable (in terms of deposition temperature and chemical process compatibility) with CMOS drive circuitry and the piezoelectric layer.

The piezoelectric layers 402 and 452 are formed from materials chosen for compatibility with the manufacture of CMOS and interconnect circuitry. CMOS drive circuitry can typically survive a temperature of up to about 450° C. However, high yield manufacturing requires a much lower peak manufacturing temperature, typically 300° C. Deposition methods that subject the CMOS drive electronics to temperatures over a duration can degrade performance, typically affecting dopant mobility and the degradation of wiring within the interconnect layer. The temperature limit restricts deposition methods for the piezoelectric layers. Suitable piezoelectric materials include aluminium nitride (AlN), aluminium nitride compounds (in particular scandium aluminium nitride (ScAlN)) and zinc oxide (ZnO), which are compatible with CMOS electronics. The composition of the piezoelectric material is chosen to optimise the piezoelectric properties. For example, the concentrations of any additional elements in aluminium nitride compounds (such as the concentration of scandium in scandium aluminium nitride) are typically chosen to optimise the magnitude of the $d_{31}$ piezoelectric constant. The higher the concentration of scandium in scandium aluminium nitride, the typically larger the value of $d_{31}$. The mass percentage of scandium in scandium aluminium nitride may be as high as 50%.

The piezoelectric actuator material is not continuous over the surface of the nozzle plate 500. The piezoelectric material is located primarily over the nozzle plate and includes a number of openings including electrode openings 404 and a region around the nozzle 405.

The protective front surface 600 is formed on the outer surface of the droplet ejector device 100 and covers the piezoelectric layers 402 and 452, the electrodes 401, 403, 451 and 453 and the nozzle plate 500. The protective front surface has openings for the nozzles 601 and for the bond pads 700. The protective front surface material is chemically inert and impermeable. The protective front surface material may also be repellent to the fluid to be ejected. The mechanical properties of the protective front surface material are chosen carefully to minimize the effect on the forcing action of the piezoelectric actuators 400 and 450 and nozzle plate 500. The protective front surface material is chosen to be manufacturable with a CMOS compatible process flow, for example in terms of processing temperature and chemical process compatibility. The protective front surface 600 prevents contact of fluid with any of the electrodes or the piezoelectric layers. Suitable protective front surface materials include polyimides, polytetrafluoroethylene (PTFE), diamond-like carbon (DLC) or related materials.

Figure 3:
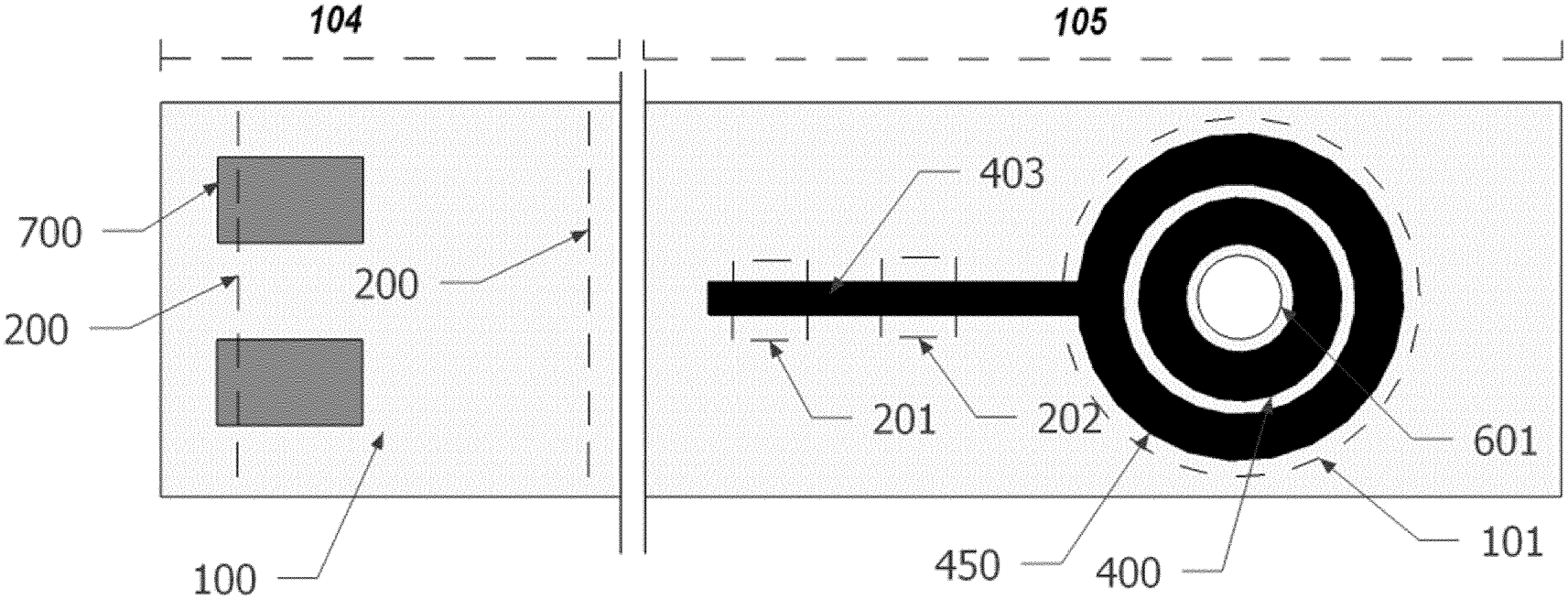
FIG. 3 is a plan view of a nozzle showing features of the monolithic droplet ejector shown in FIG. 1 with a protective coating removed.

FIG. 3 is a plan view of a nozzle showing features of the monolithic droplet ejector structure 1 with the protective coating 600 removed according to the first embodiment. The dashed line shows the underlying position of the fluid inlet 103 in relation to the piezoelectric inner actuator 400 and the outer piezoelectric actuator 450.

In use, the fluid droplet ejector device 1 is mounted on a substrate that can supply fluid to the fluid inlet 103. Fluid pressure is typically slightly negative at the fluid inlet 103 and the fluid inlet channels 101 typically "prime" or fill with fluid by surface tension driven capillary action. The nozzles 601 prime up to the outer surface of the protective front surface 600 due to capillary action once the fluid inlets 103 are primed. The fluid does not move onto the outer surface of the protective surface 600 past the nozzles 601 due to the combination of negative fluid pressure and the geometry of the nozzle 601.

The actuator drive circuitry 201 and 202 controls the application of a voltage pulse to the drive electrodes 401, 403, 451 and 453, according to a timing signal from the overall drive circuitry 203. The application of electrode voltage across the piezoelectric material layers 402 and 452 creates two electric fields. The electric fields cause deformation of the piezoelectric material layers 402 and 452. The deformation can either be a tensile or compressive strain depending on the orientation of the electric field with respect to the local direction of polarization in the material. The induced strain caused by the expansion or contraction of the piezoelectric materials 402 and 452 typically induces a strain gradient through the thickness of the nozzle plate 500, piezoelectric actuators 400 and 450 and the protective front layer 600, causing a movement or displacement of the nozzle plate relative to a neutral position.

The piezoelectric properties of the piezoelectric materials can be characterized in part by the transverse piezoelectric constant $d_{31}$. $d_{31}$ is the particular component of the piezoelectric coefficient tensor which relates the electric field applied across the piezoelectric material in a first direction to the strain induced in the piezoelectric material along a second direction perpendicular to said first direction. The piezoelectric actuators 400 and 450 shown are configured such that the applied electric fields induce strains in the material layers in directions perpendicular to the directions in which the fields are applied and are therefore characterized by the $d_{31}$ constant.

Due to the uniform thickness and composition of both piezoelectric material layers 402 and 452, and due to the electrical cross-connections between electrodes 403 and 451 and electrodes 401 and 453, the application of a constant voltage or a voltage pulse results in a first potential difference being applied across the inner actuator layer and a second potential difference being applied across the outer actuator layer, wherein the first and second potential differences are equal in magnitude but opposite in polarity. Expressed in a different way, an electric field $E_1$ is set up across the inner actuator piezoelectric layer and an electric field $E_2$ is set up across the outer actuator piezoelectric layer, wherein $E_1$ and $E_2$ are equal in magnitude but act in opposite directions. Because $E_1$ and $E_2$ act in opposite directions, the inner and outer actuator layers deform in opposite senses. Dependent on the polarity of $E_1$ and $E_2$, displacement X of the nozzle plate 500 is either positive or negative relative to a neutral position (i.e. when there are no applied electric fields). A positive displacement of the nozzle plate is shown in the upper portion of FIG. 4(*a*) whereas a negative displacement of the nozzle plate is shown in the lower portion of the figure.

The application of pulsed electric fields can cause oscillations of the nozzle plate 500. Oscillation of the nozzle plate typically induces a pressure in the fluid inlet 103 under the nozzle plate 500 which causes droplet ejection out of the nozzle 601. The frequency and amplitude of the nozzle plate oscillation is primarily a function of the mass and stiffness characteristics of the nozzle plate 500, piezoelectric actuators 400 and 450, the protective layer 600, the fluid properties (for example, the fluid density, fluid viscosity (either Newtonian or non-Newtonian) and surface tension), nozzle and fluid inlet geometries and the configuration of both drive pulses.

Figure 4B:
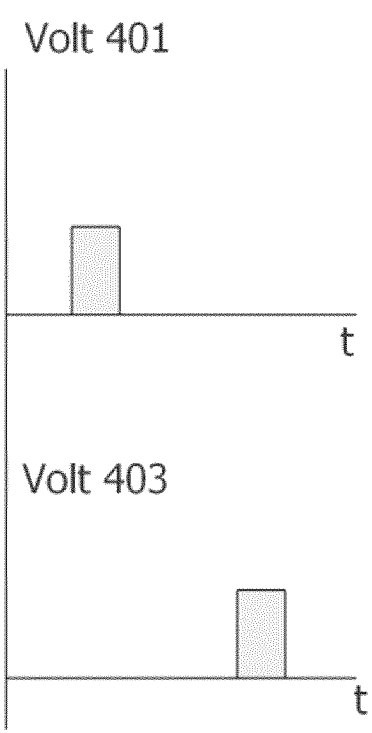
FIGS. 4(*a*) and 4(*b*) show a schematic of drive pulse implementations for the droplet ejector device of FIG. 1.
Figure 4A:
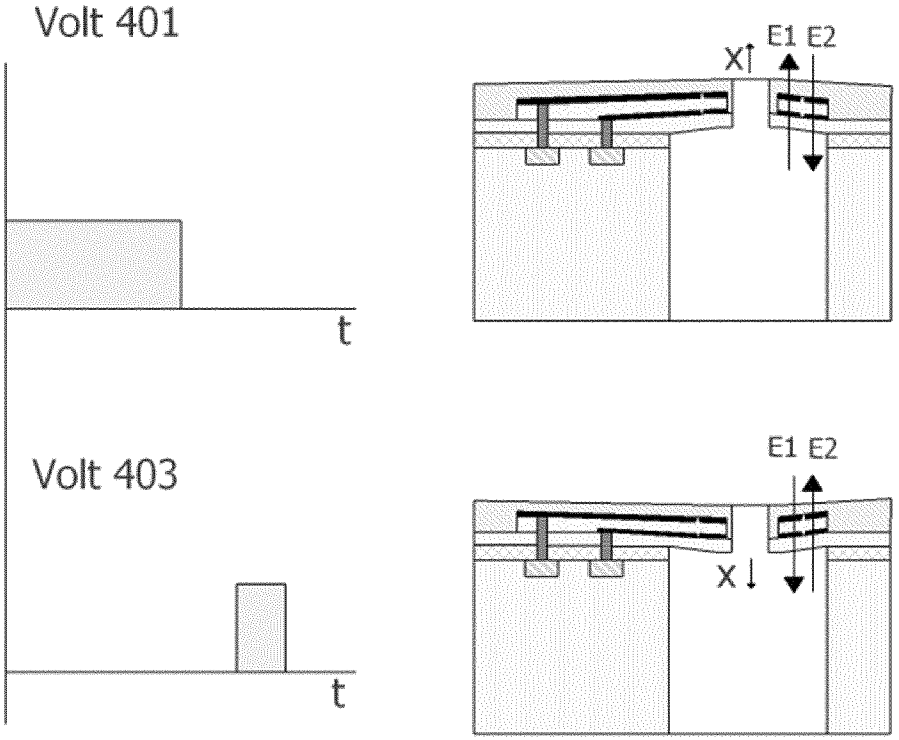

FIGS. 4(*a*) and 4(*b*) show two drive pulse implementations. Voltage pulses across the inner actuator electrodes 401 and 403 are shown in the diagram. It will be understood that voltage pulses equal in magnitude but opposite in polarity are simultaneously applied across outer actuator electrodes 451 and 453.

In a first implementation, the application of a steady state or DC electric field across the electrode pairs causes a distortion of the piezoelectric layers 402 and 452 and a steady state deflection of the nozzle plate away from the fluid inlet as shown in the upper portion of FIG. 4 (*a*). The fluid pressure under the nozzle plate is the same as the fluid inlet supply pressure. Strain energy is stored in the nozzle plate 500, the piezoelectric actuators 400 and 450 and the protective layer 600.

The electric fields are then removed and a reverse electric field pulse is applied as shown in the lower portion of FIG. 4 (*a*). This causes both a release of the stored strain energy and further distortion of the piezoelectric materials in the opposite direction. The nozzle plate moves towards the fluid inlet, which causes a positive pressure in the fluid inlet and nozzle region and droplet ejection out of the nozzle 601. The reverse electric field pulse may come immediately after the removal of the DC field or at a slightly delayed duration.

The final removal of the electric fields across the piezoelectric materials causes the nozzle plate 500 to return to a neutral position with no induced strain.

Figure 10:
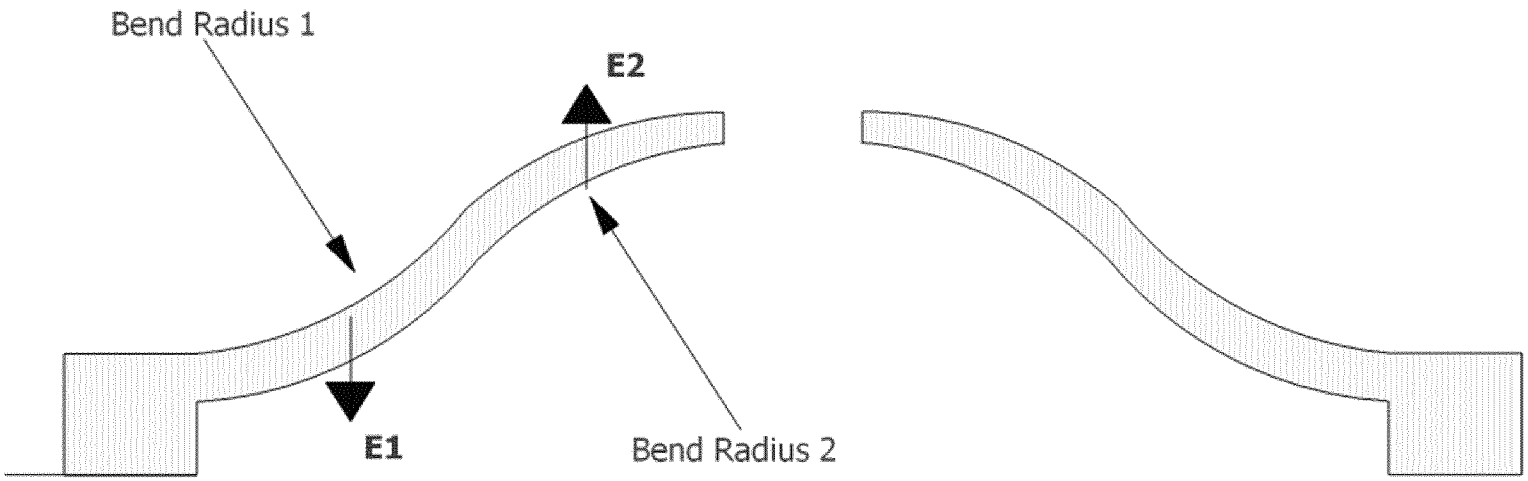
FIG. 10 is a cross-sectional view through the nozzle structure on actuation of any of the droplet ejector devices of FIG. 1, FIG. 6, FIG. 8 or FIG. 9.

The application of electric fields of opposing polarity across the inner and outer actuators causes the nozzle plate to deform into the shape shown in FIG. 10. The nozzle plate in the region of the inner actuator curves in an opposite sense relative to the curvature of the nozzle plate in the region of the outer actuator, resulting in a sigmoidal cross-section. This particular shape significantly increases the maximum displacement of the nozzle portion of the nozzle plate from the neutral position when compared to the displacement achievable when a nozzle plate is provided with only one actuator causing curvature in only one sense. By increasing the maximum displacement of the nozzle plate away from the neutral position, a much greater ejection force can be exerted when the applied field is removed or reversed in polarity. This enables the use of piezoelectric materials having low $d_{31}$ constants, which are normally considered unsuitable for use in inkjet printers due to the low forces they are capable of generating. These low-$d_{31}$ materials are typically processable at lower temperatures, enabling closer integration of the droplet ejector with CMOS components. The larger ejection forces achievable also permit the overall ejector size to be reduced so that increased printhead nozzle densities are possible.

In a second implementation, the DC electric field configuration described in FIG. 4(*a*) with a pulse field configuration as shown in FIG. 4(*b*). This has the advantage of minimizing any applied strain effects over longer durations. An additional advantage of the dual pulsed approach is enabled by the timing of the field pulse switching application. The application of the first pulse will induce an oscillation with an initial nozzle plate movement away from the fluid inlet as shown in the upper portion of FIG. 4(*b*). This oscillation will introduce a negative fluid pressure under the nozzle plate which introduces a net fluid flow towards the nozzle which can additionally augment the fluid ejection flows through the nozzle.

Figure 5:
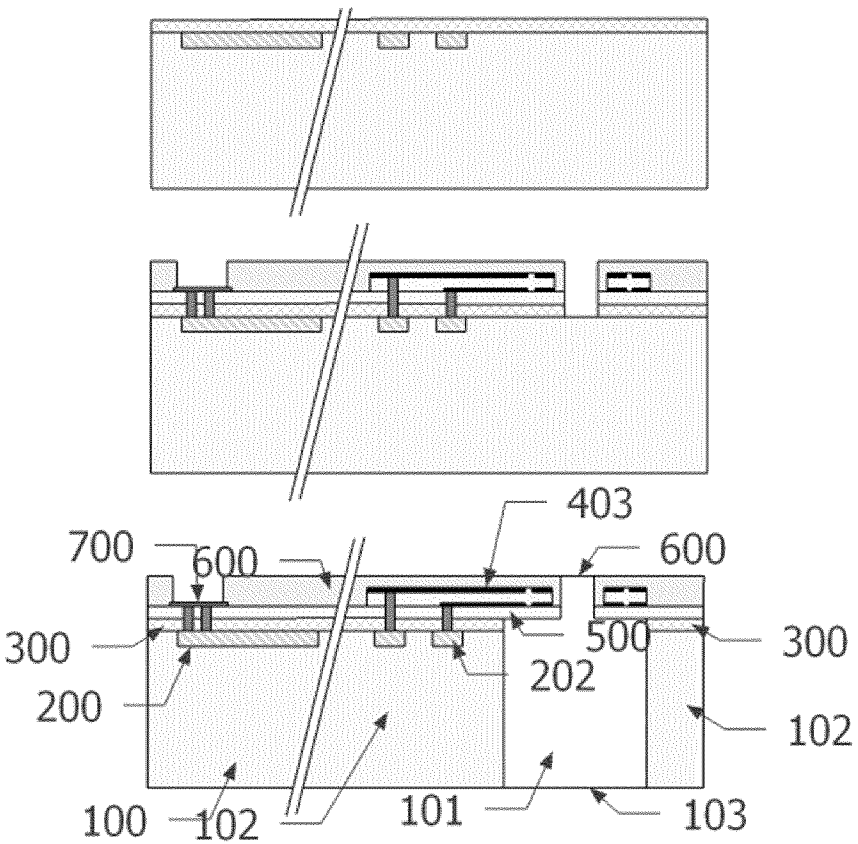
FIG. 5 is a schematic of the manufacturing process flow for manufacturing the droplet ejector device of FIG. 1.

FIG. 5 is a schematic showing the manufacturing process flow for the droplet ejector device. The first manufacturing step, as shown in FIG. 5(*a*), is to create drive circuitry and the interconnect layer 300, for example CMOS drive circuitry and interconnects, on a surface of a silicon wafer substrate. CMOS drive circuitry is formed by standard processes—for example ion implantation on p-type or n-type substrates followed by the creation of a wiring interconnect layer by standard CMOS fabrication processes (e.g. ion implantation, chemical vapour deposition (CVD), physical vapour deposition (PVD), etching, chemical-mechanical planarization (CMP) and/or electroplating).

Subsequent manufacturing steps are implemented to define features and structures of the monolithic droplet ejector device. Subsequent steps are chosen not to damage structures formed in previous steps. A key manufacturing parameter is the peak processing temperature. Problems associated with processing CMOS at high temperatures include the degradation of dopant mobility and interconnect wiring schemes. CMOS electronics are known to survive temperatures of 450° C. However, a much lower temperature (i.e. below 300° C.) is desirable for high yield.

The nozzle plate 500, the piezoelectric actuators 400 and 450, the protective layer 600 and the bond pads 700 are formed on top of the interconnect layer as shown in FIG. 5(*b*).

The nozzle plate 500 is deposited using a CVD or PVD process.

The formation of a CMOS compatible piezoelectric material 402 and 452 is of particular interest as this is the key driving element of the actuator. FIG. 19 shows Table 1 which lists some common piezoelectric materials and the manufacturing methods associated with them, along with typical $d_{31}$ values. It can be seen that materials with the highest $d_{31}$ values are incompatible with manufacture of monolithic CMOS structures. Materials that are compatible with CMOS structures have low $d_{31}$ values and hence a much lower forcing capability.

As can be seen from the table, although lead zirconate titanate (PZT) can be deposited by PVD (including sputtering) at low temperatures, it subsequently requires a post process anneal at a temperature above the allowable temperature for CMOS. PZT can also be deposited by sol gel methods, but this again requires a high temperature anneal above the CMOS limit. PZT also has a very slow rate of deposition that is not viable commercially. PZT additionally contains lead, which is undesirable environmentally.

ZnO, AlN and AlN compounds (such as ScAlN) materials can be deposited using low-temperature PVD (e.g. sputtering) processes that do not require post processing such as annealing. These materials also do not require poling. A poling step is required for PZT, wherein the material is subjected to a very high electric field which orients all the electric dipoles in the direction of the field.

ZnO, AlN and AlN compounds (e.g. ScAlN) materials are therefore commercially viable materials for the fabrication of a monolithic droplet ejector device. However, the value of $d_{31}$ for these materials is significantly lower than that of PZT. The particular configuration of the nozzle (i.e. the actuatable nozzle plate), which improves ejection efficiency, and the use of two pairs of control electrodes, which improves actuation efficiency, counter the lower $d_{31}$ value associated with these materials.

Actuator electrode materials are deposited using a CMOS compatible process such as PVD (including low-temperature sputtering). Typical electrode materials may include titanium (Ti), platinum (Pt), aluminium (Al), tungsten (W), molybdenum (Mo) or alloys thereof. The electrodes are defined by standard patterning and etch methods.

Protective materials can be deposited and patterned using a spin on and cure method (suitable for polyimides or other polymeric materials). Some materials, such as PTFE, may require more specific deposition and patterning approaches.

Bond pads are deposited using methods such as CVD or PVD (e.g. sputtering).

The fluid inlet channels are defined using high aspect ratio Deep Reactive Ion Etching (DRIE) methodologies as shown in FIG. 5(*c*). The fluid inlets are aligned to the nozzle structures using a wafer front-back side alignment tool. The wafer may be mounted on a handle wafer during the front-back alignment and etch steps.

The DRIE approach may also be used to singulate the die, however, other approaches may be used such as a wafer saw.

Second Example Embodiment

Figure 6:
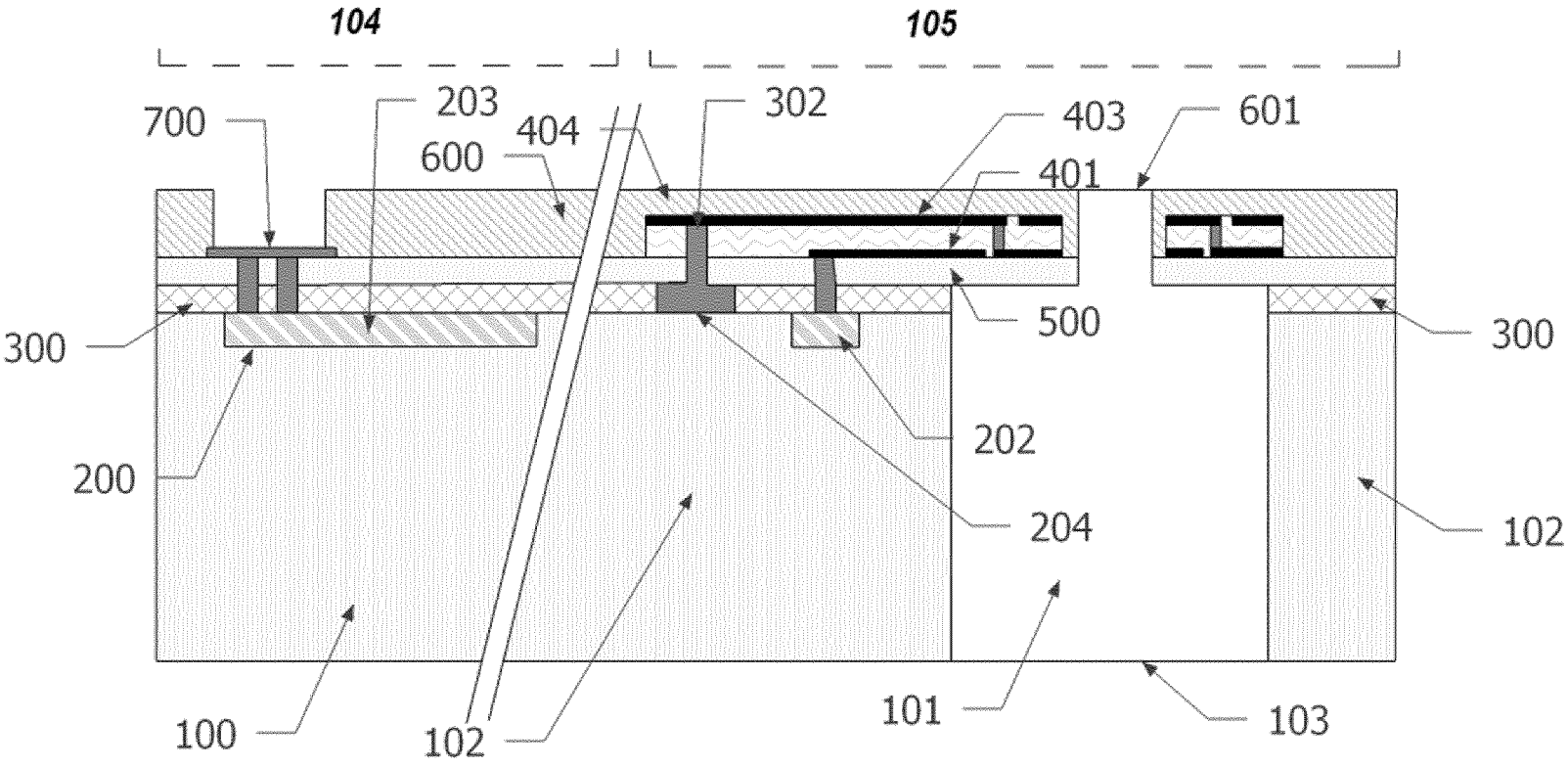
FIG. 6 is a cross-sectional view showing an alternative implementation of the electrode structure according to a second example embodiment of the invention.

FIG. 6 is a cross sectional view showing an alternative implementation of the electrode structure. In this embodiment the electrodes 403 and 453 are connected by wiring, 302, to a ground line 204 rather than drive circuitry. The ground line 204 is located within the interconnect layer 300 and is connected to the drive circuitry region 203 or directly to grounded bond pads 700.

Third Example Embodiment

Figure 7:
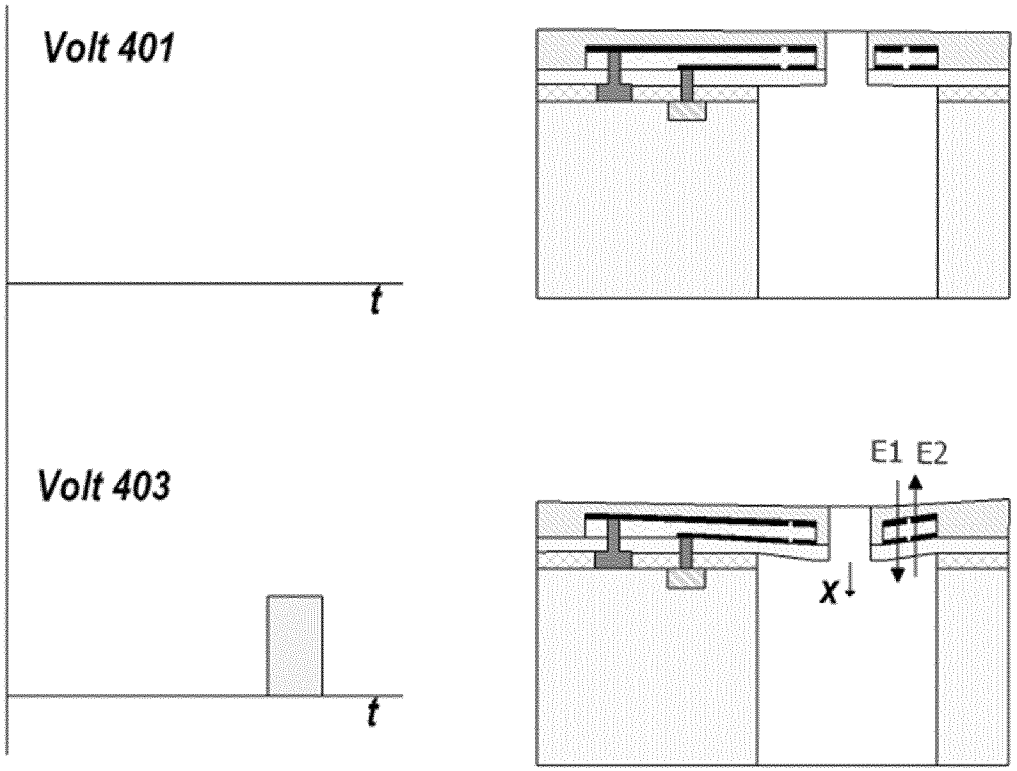
FIG. 7 is a schematic showing an alternative drive pulse implementation for the droplet ejector device of FIG. 6.

FIG. 7 is a schematic showing an alternative drive pulse implementation compatible with this droplet ejector device. A voltage pulse, as shown in FIG. 7, is applied to only one electrode of each electrode pair, for example 401 and 453. This creates an electric field through the piezoelectric actuators 400 and 450 that creates a downward overall displacement of the nozzle plate 500. It is also possible to configure the device with a drive pulse applied to electrodes 403 and 451 and a ground voltage applied to electrode 401 and 453.

Fourth Example Embodiment

Figure 8:
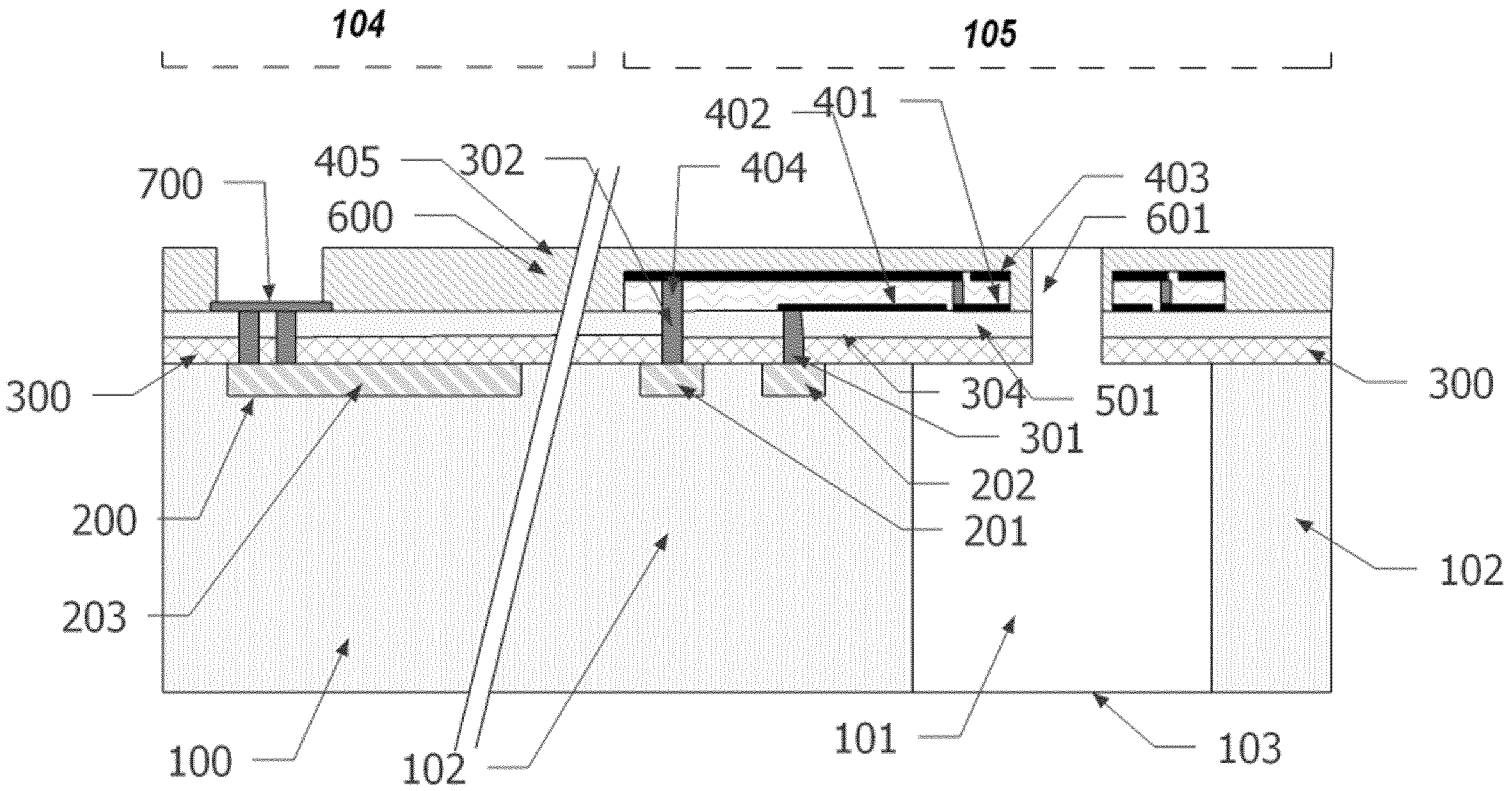
FIG. 8 is a schematic showing a cross section through an alternative implementation of the nozzle structure according to a third example embodiment of the invention.

FIG. 8 is a schematic showing a cross section of an alternative implementation of the nozzle structure and shows the extension of the interconnect layer 304 attached to the nozzle plate layer 500 in the vicinity of the fluid inlet 101. The interconnect layer extension 304 may comprise solely dielectric material without any wiring. In another variation, the device has no nozzle plate layer and only an interconnect layer attached to the piezoelectric actuator.

Fifth Example Embodiment

Figure 9:
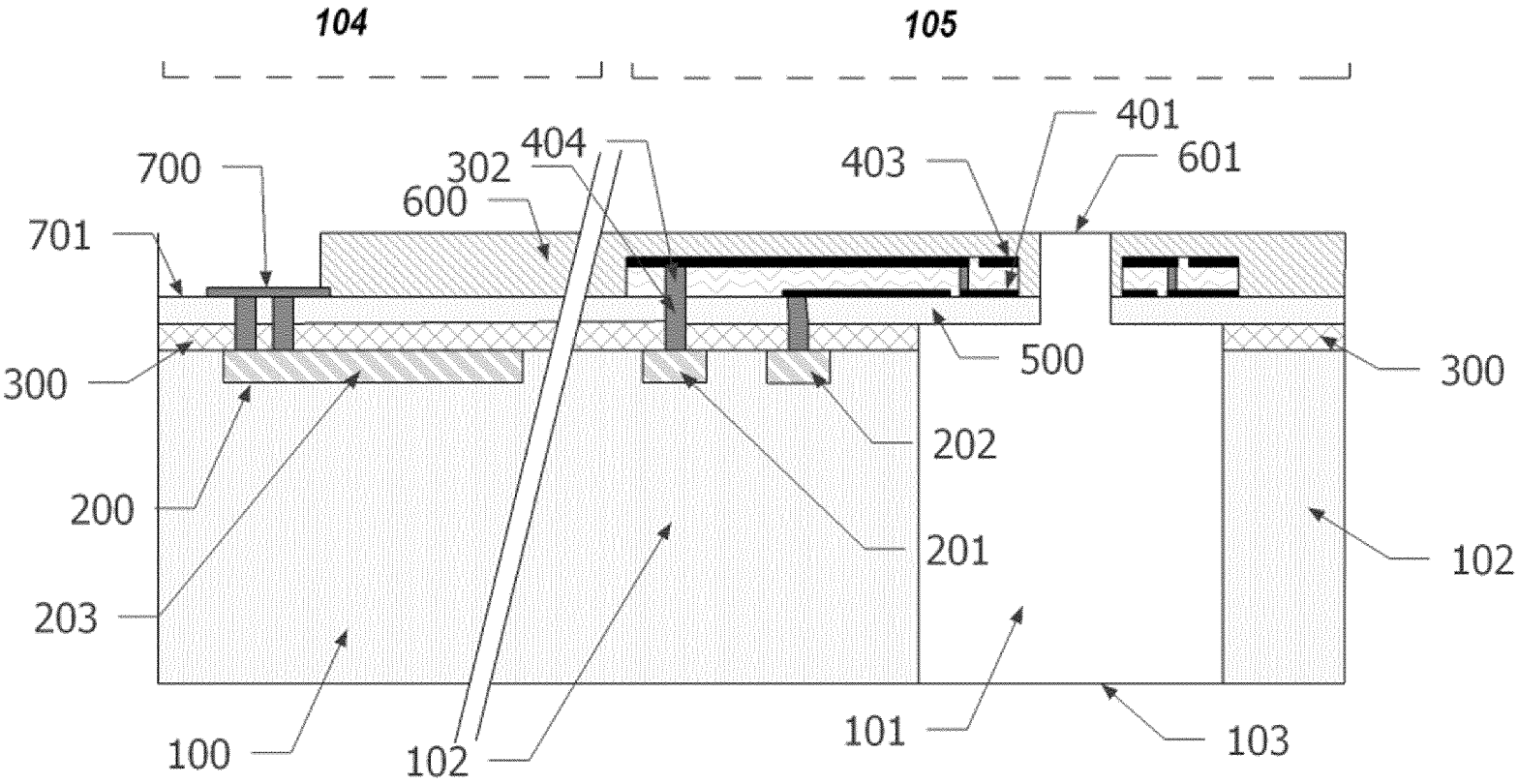
FIG. 9 is a cross-sectional view showing an alternative implementation of bond pad structures according to a fourth example embodiment of the invention.

FIG. 9 is a cross-sectional view showing an alternative implantation of the bond pad structures. The protective front surface has been removed in the vicinity of the bond pads 701. This geometry improves accessibility of external wiring schemes and reduces the overall height of wire bonding above the height of the chip.

Sixth and Seventh Example Embodiments

Figure 11:
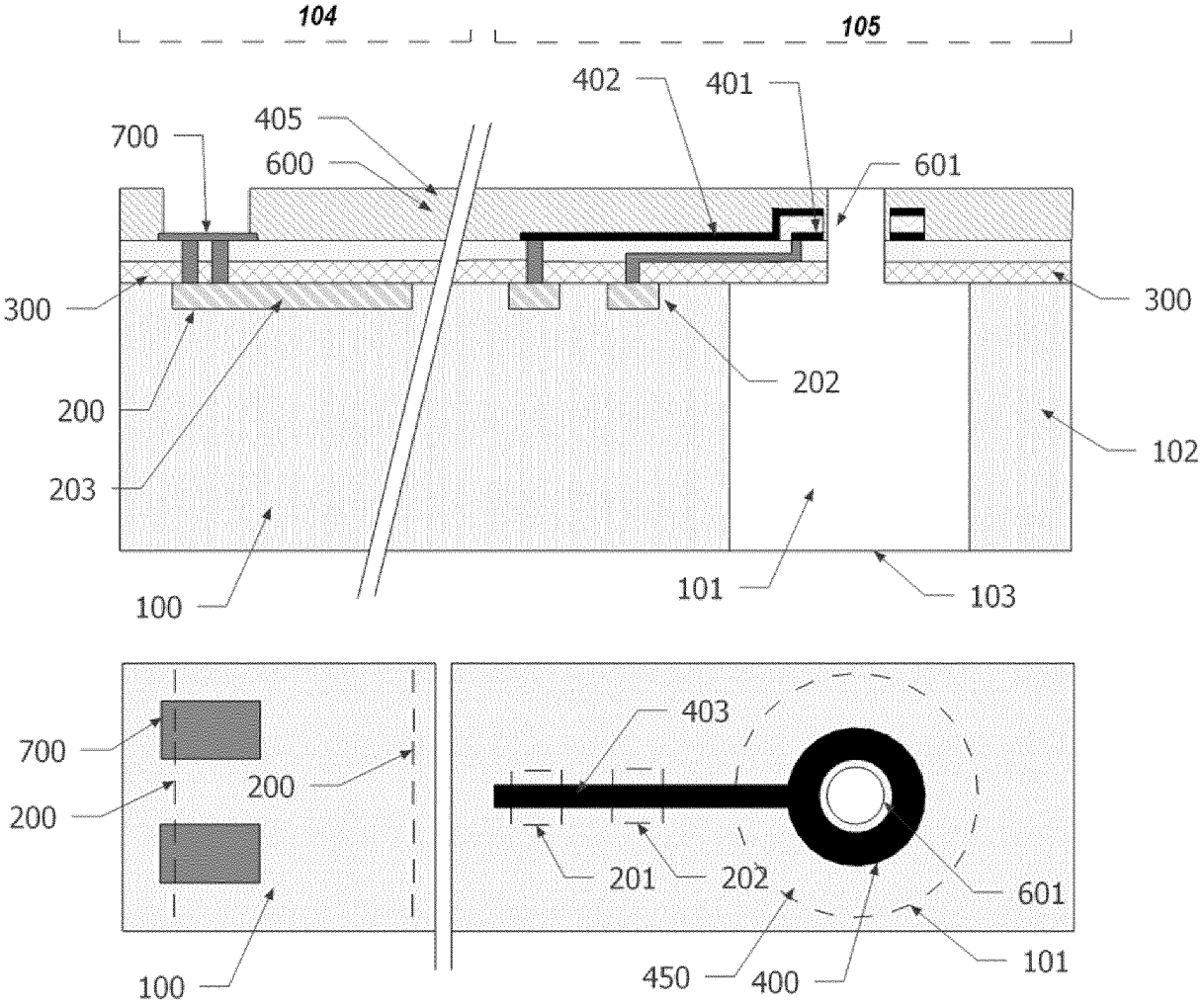
FIG. 11 provides both a cross-sectional view and a plan view of showing an alternative monolithic droplet ejector having only an inner actuator arrangement according to a fifth example embodiment of the invention.

FIG. 11 is a schematic showing a cross section and plan view of an alternative implementation of the nozzle structure which includes only an inner piezoelectric actuator 400 adjacent the fluid outlet 601. In this embodiment, the piezoelectric material only extends between the electrodes 401 and 402 and does not extend beyond the electrodes over the remainder of the nozzle plate layer 500 (i.e. it does not extend into the region 450 where an outer piezoelectric actuator might be expected to be located).

Figure 12:
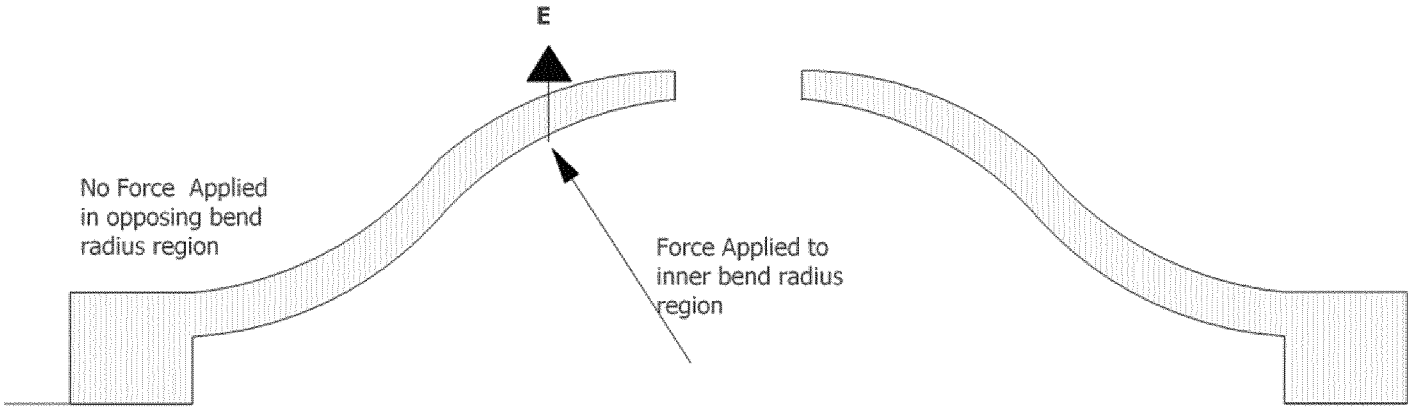
FIG. 12 is a cross-sectional view through the nozzle structure on actuation of the droplet ejector device of FIG. 11.

The application of an electric field across the inner actuator causes the nozzle plate to deform into the shape shown in FIG. 12. Actuation of the inner actuator causes the inner portion of the nozzle plate to curve in a first sense. The outer portion of the nozzle plate in response curves in an opposite sense, resulting in a sigmoidal cross-section. This particular shape significantly increases the maximum displacement of the nozzle portion of the nozzle plate from the neutral position when compared to the displacement achievable when a nozzle plate is provided with only one actuator extending over the majority of the nozzle plate, which typically causes curvature in only one sense.

Figure 13:
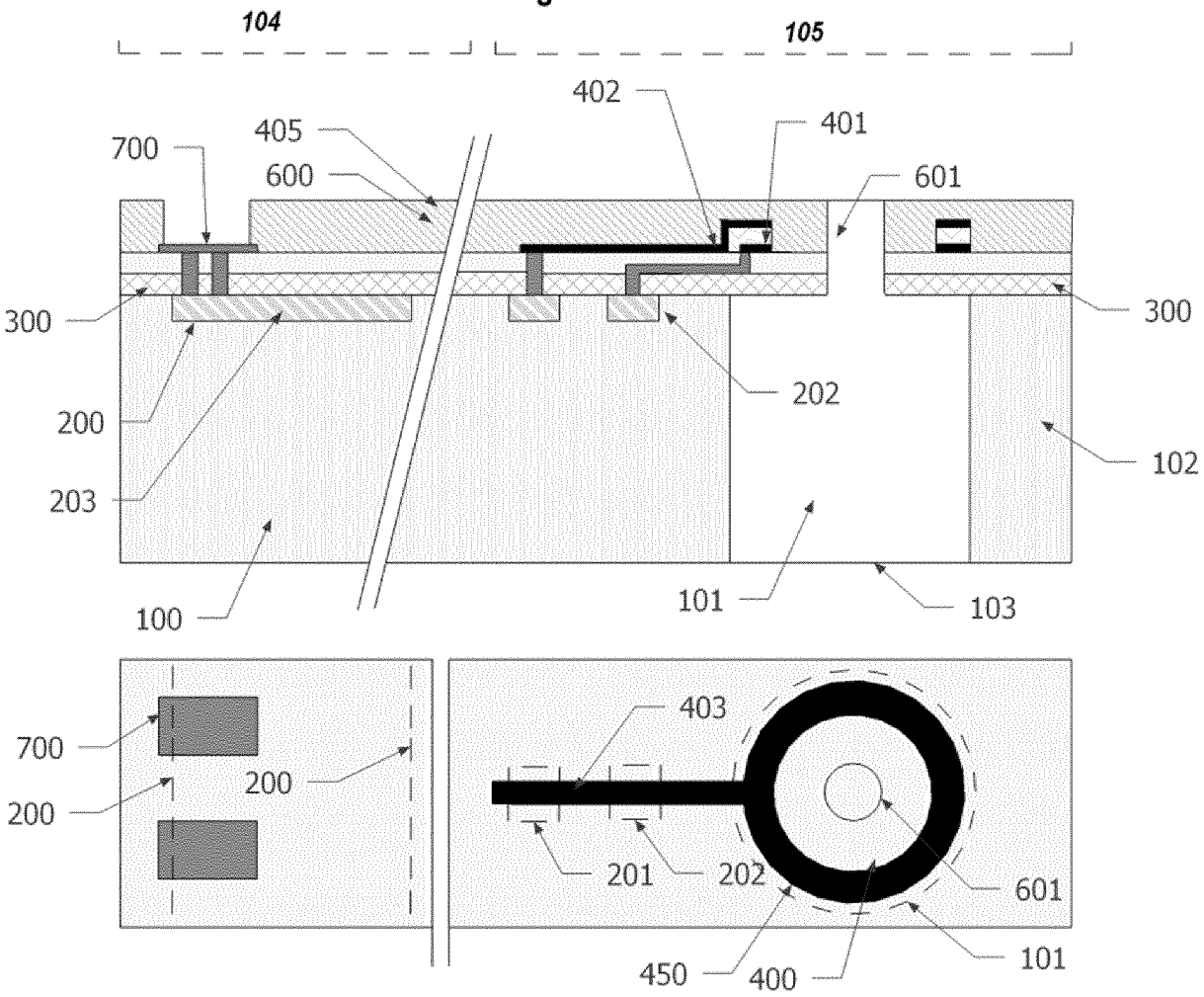
FIG. 13 provides both a cross-sectional view and a plan view of showing an alternative monolithic droplet ejector having only an outer actuator arrangement according to a sixth example embodiment of the invention.
Figure 14:
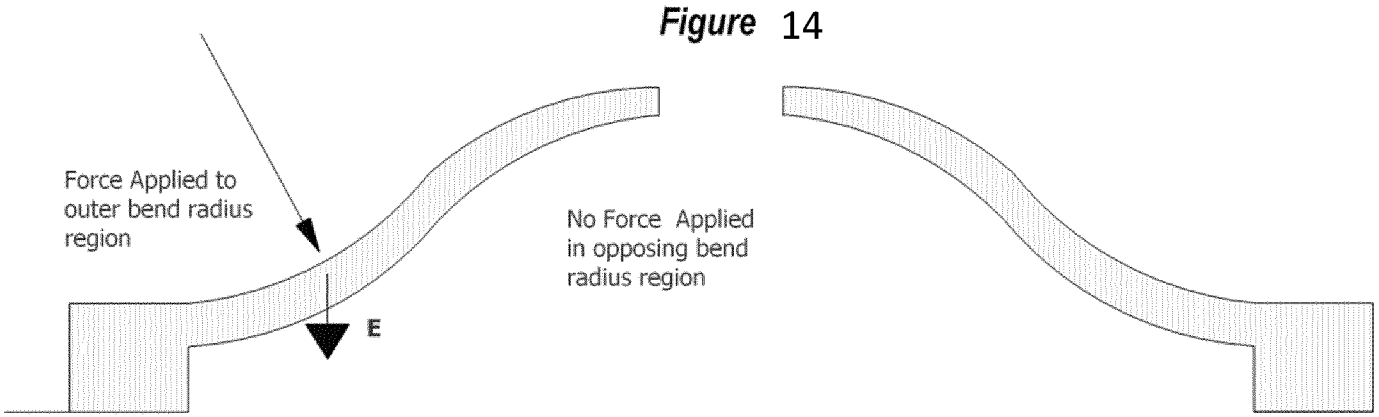
FIG. 14 is a cross-sectional view through the nozzle structure on actuation of the droplet ejector device of FIG. 13.

In addition, FIG. 13 is a schematic showing a cross section and plan view of an alternative implementation of the nozzle structure which includes only an outer piezoelectric actuator 450 adjacent the fluid outlet 601. In this embodiment, the piezoelectric material only extends between the electrodes 401 and 402 and does not extend beyond the electrodes over the remainder of the nozzle plate layer 500 (i.e. it does not extend into the region 400 where an inner piezoelectric actuator might be expected to be located).

The application of an electric field across the outer actuator causes the nozzle plate to deform into the shape shown in FIG. 12. Actuation of the outer actuator causes the outer portion of the nozzle plate to curve in a first sense. The inner portion of the nozzle plate in response curves in an opposite sense, resulting in a sigmoidal cross-section. This particular shape significantly increases the maximum displacement of the nozzle portion of the nozzle plate from the neutral position when compared to the displacement achievable when a nozzle plate is provided with only one actuator extending over the majority of the nozzle plate, which typically causes curvature in only one sense.

Figure 15:
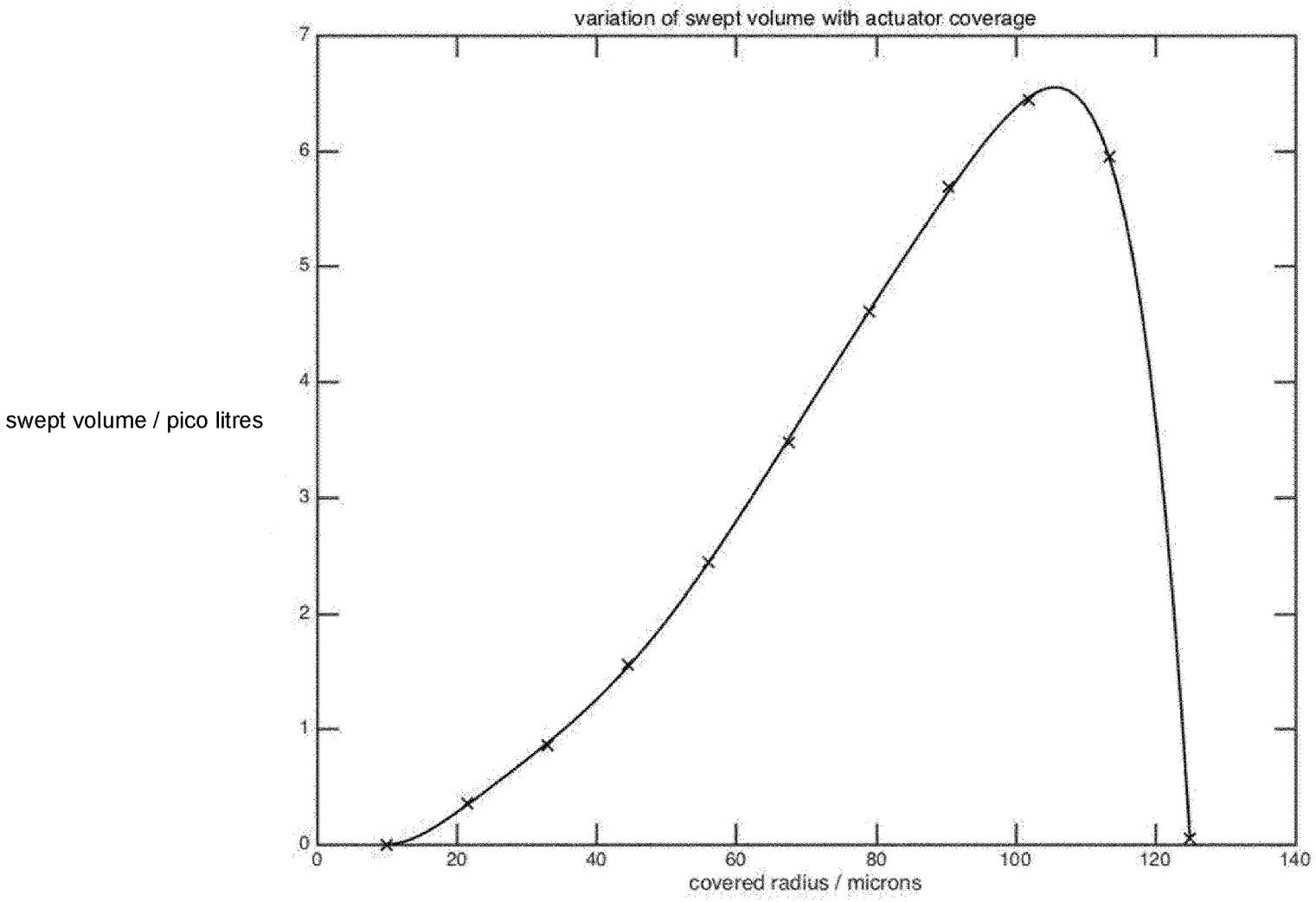
FIG. 15 is a plot of showing the volume swept by a droplet ejector device diaphragm as a function of the location of the actuator arrangement.
Figure 16:
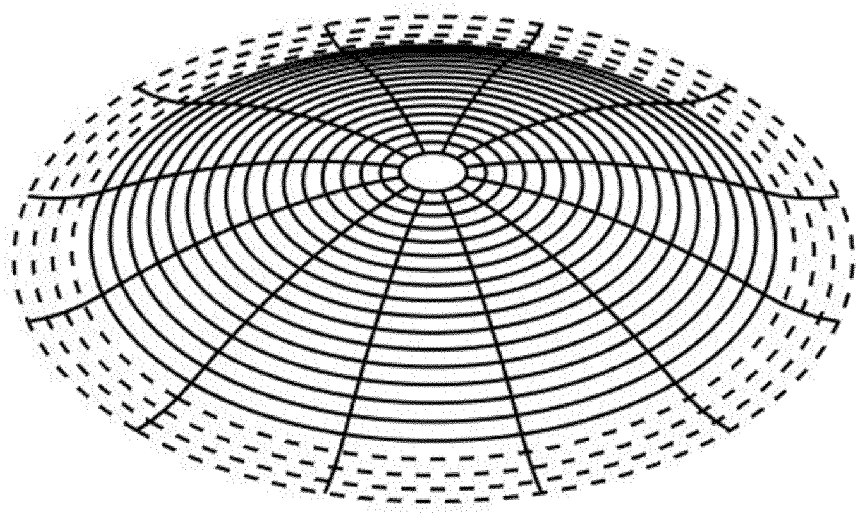
FIG. 16 shows in 3D the shape assumed by a diaphragm of a droplet ejector device according to FIGS. 1, 6, 8, 9, 11 and 13 on actuation.

FIG. 15 shows the volume swept by the nozzle plate on actuation as a function of the radial location of a single annular actuator positioned symmetrically about the fluid outlet. In this case the layer of piezoelectric material extends across the entire nozzle plate and the location of the actuator is defined by the location of first and second actuator electrodes. The nozzle plate has an outer radius of 125 microns. It can be seen from this Figure that the maximum swept volume (and therefore fluid ejection) is achievable for an actuator located close to the outer periphery (at a location 105 microns from the centre) of the nozzle plate. FIG. 16 shows the 3D shape taken up by the nozzle plate on actuation of a single annular actuator located closer to the outer periphery. The inner portion of the nozzle plate can be seen to curve in an opposite sense from the outer portion of the nozzle plate.

Figure 17:
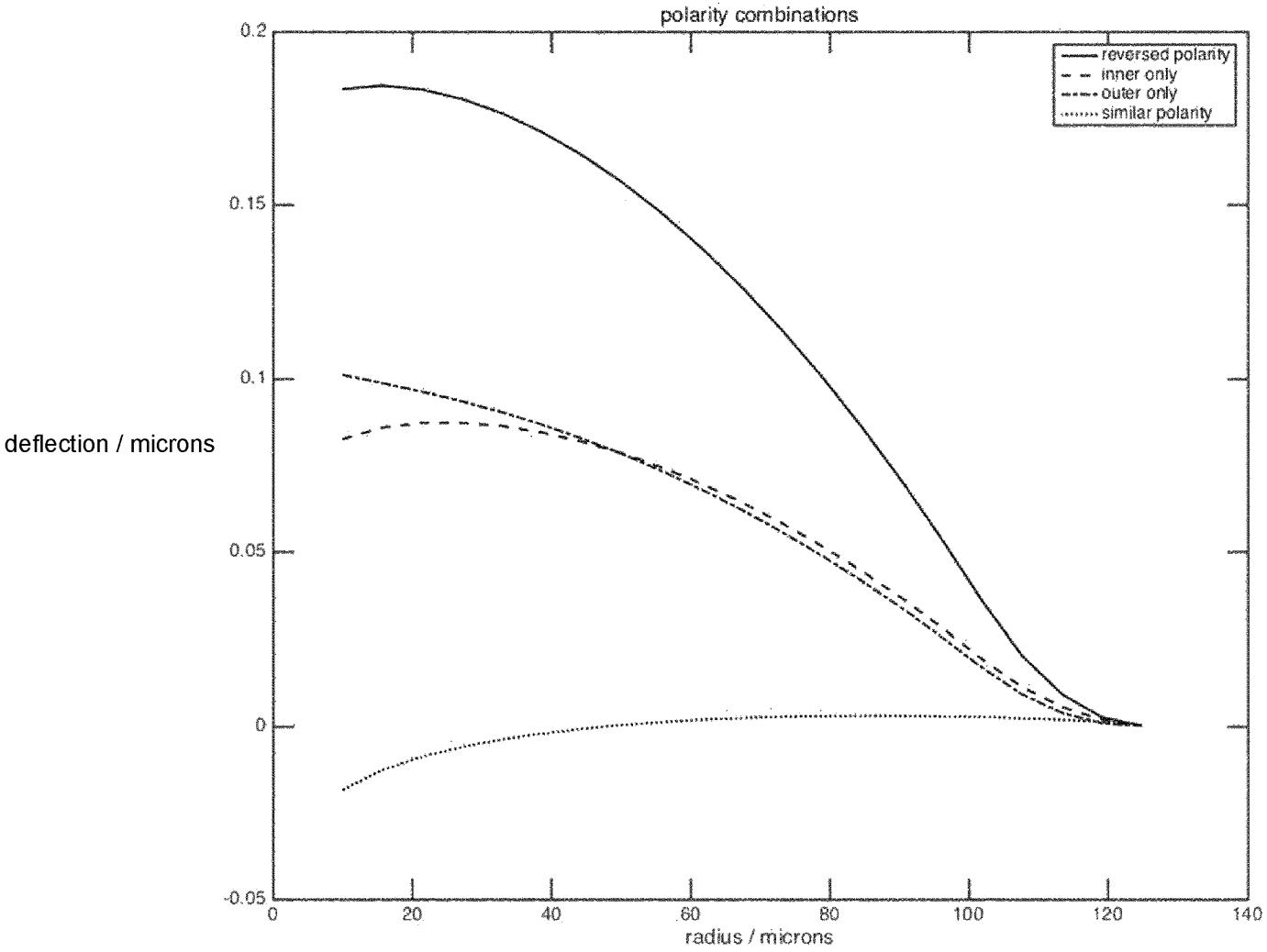
FIG. 17 is a plot showing the deflection of the droplet ejector diaphragm for four different actuation implementations.

FIG. 17 shows how the deflection of the nozzle plate from a neutral position (i.e. before actuation of any actuators) varies as a function of radial location across the nozzle plate in embodiments comprising both inner and outer piezoelectric actuators. The Figure shows data sets for: "Reversed Polarity" (both inner and outer annular actuators are provided, each being actuated concurrently by electric fields having opposed polarities); "Similar Polarity" (both inner and outer annular actuators are provided, each being actuated concurrently by electric fields having the same polarity); "Inner only" (both inner and outer annular actuators are provided, but only the inner actuator is actuated); and "Outer only" (both inner and outer annular actuators are provided, but only the outer actuator is actuated). In such embodiments, maximum deflection is achieved when electric fields having opposing polarities are applied to the inner and outer actuators.

Figure 18:
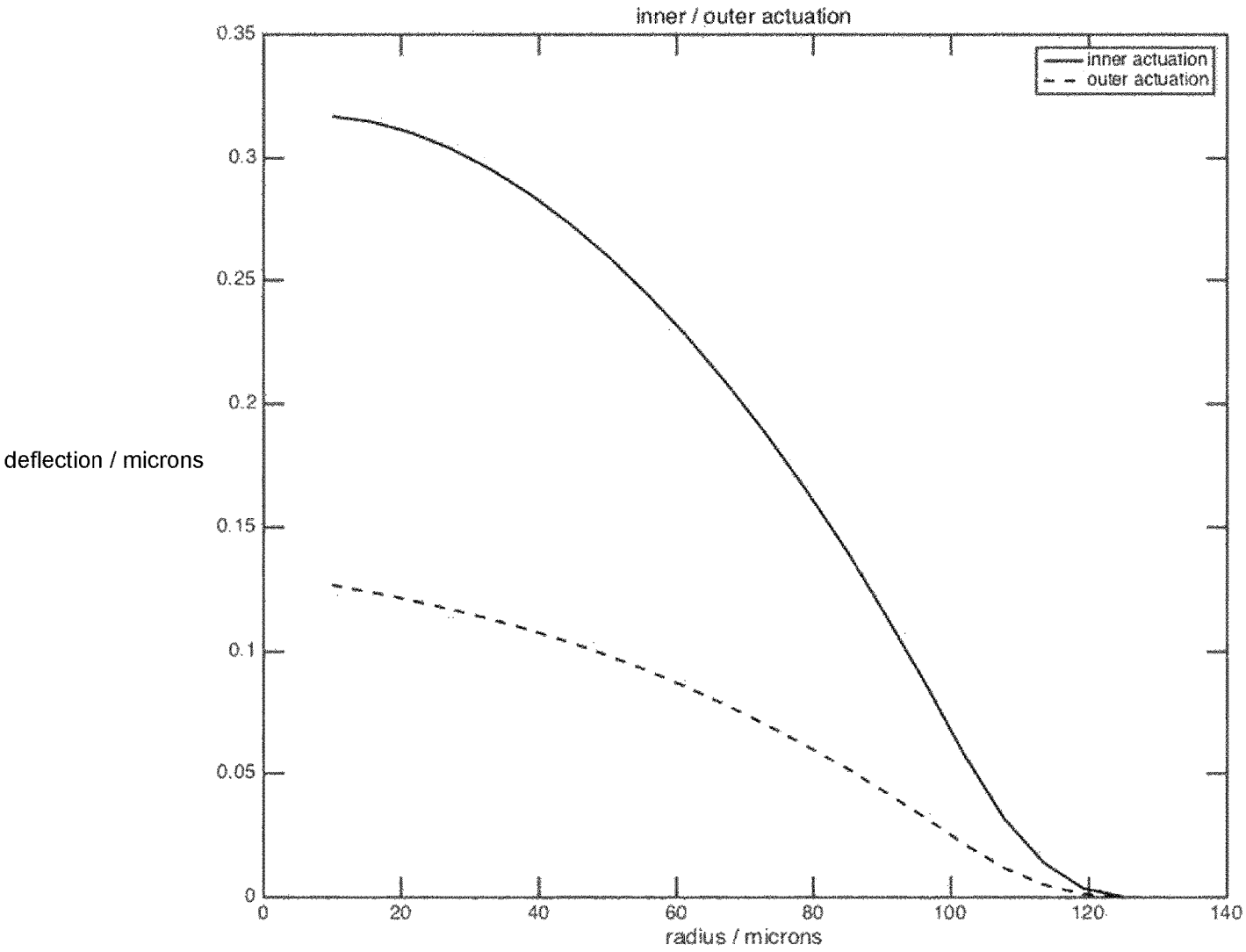
FIG. 18 is a plot showing the deflection of the droplet ejector diaphragm for two different actuator configurations as a function of location of the actuator arrangements on the diaphragm.

FIG. 18 also shows how the deflection of the nozzle plate from the neutral position varies as a function of radial location across the nozzle plate for embodiments comprising only a single piezoelectric actuator in which the piezoelectric material does not extend beyond said piezoelectric actuator. In such embodiments, maximum deflection is achieved when an inner actuator is provided. The lack of piezoelectric material in the region not containing an actuator leads to increased flexibility and therefore potentially greater deflections can be achieved by ejectors incorporating a single annular piezoelectric actuator (whether inner or outer) compared to ejectors incorporating both inner and outer piezoelectric actuators.

Further variations and modifications may be made within the scope of the invention herein disclosed.

The device may be formed on a silicon wafer substrate. Alternatively, the substrate may comprise a silicon-on-insulator wafer or III-V semiconductor wafer.

The fluid inlet channels may be substantially cylindrical and therefore have substantially circular cross-sections in the plane of the substrate. Alternatively, the fluid inlet channels may take a variety of other cross-sections including multiple-sided, regular or irregular shapes. The shape of the fluid inlet channels is typically dependent on other aspects of the monolithic chip design such as the layout of nozzles, the drive electronics placement and the wiring routing in the interconnect layer 300.

The cross-sectional shapes may also be selected to minimize the width of the printhead chip without introducing failure mechanisms. Failure mechanisms may be structural (for example, too many fluid inlets may reduce the robustness of the chip) or they may be operational (for example, interconnect wires may be insufficient to carry the appropriate current). A reduced printhead width is desirable because it increases the number of chips which can be manufactured on a single wafer.

Further variations and modifications may be made within the scope of the invention herein disclosed.

The invention claimed is:

1. A droplet ejector for a printhead, the droplet ejector comprising: a substrate having a mounting surface and an opposite nozzle surface; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the nozzle-forming layer, the nozzle portion comprising an inner portion located closer to the fluid chamber outlet and an outer portion located closer to a periphery of the nozzle portion; and an inner actuator arrangement formed on the inner portion of the nozzle portion of the nozzle-forming layer, the inner actuator arrangement comprising one or more inner piezoelectric actuators, at least one of said one or more inner piezoelectric actuators comprising an inner piezoelectric body provided between an inner pair of drive electrodes.

2. The droplet ejector according to claim 1, wherein the outer portion of the nozzle portion of the nozzle-forming layer at least partially surrounds the inner portion of the nozzle portion of the nozzle-forming layer.

3. The droplet ejector according to claim 1, wherein the inner actuator arrangement at least partially surrounds the fluid chamber outlet.

4. The droplet ejector according to claim 1, comprising an outer actuator arrangement formed on the outer portion of the nozzle of the nozzle forming layer and wherein inner and/or outer actuator arrangements are substantially annular.

5. The droplet ejector according to claim 1, wherein the inner actuator arrangement consists of a single inner piezoelectric actuator which is substantially annular.

6. The droplet ejector according to claim 1 comprising an outer actuator arrangement formed on the outer portion of the nozzle portion of the nozzle forming layer, wherein the outer actuator arrangement comprises one or more outer piezoelectric actuators, at least one of said one or more outer piezoelectric actuators comprising an outer piezoelectric body provided between an outer pair of drive electrodes.

7. The droplet ejector according to claim 6, wherein the outer actuator arrangement consists of a single outer piezoelectric actuator which is substantially annular.

8. The droplet ejector according to claim 7, wherein the single outer piezoelectric actuator surrounds the single inner piezoelectric actuator.

9. The droplet ejector according to claim 1, wherein the inner piezoelectric body or bodies comprise one or more piezoelectric materials processable at a temperature below 450° C.

10. The droplet ejector according to claim 9, wherein the one or more piezoelectric materials are PVD-deposited piezoelectric materials.

11. The droplet ejector according to claim 9, wherein the one or more piezoelectric materials comprise aluminium nitride and/or zinc oxide.

12. The droplet ejector according to claim 9, wherein the one or more piezoelectric materials are non-ferroelectric piezoelectric materials.

13. The droplet ejector according to claim 1, wherein the inner piezoelectric body or bodies comprise one or more piezoelectric materials depositable at a temperature below 450° C.

14. The droplet ejector according to claim 1, wherein the inner piezoelectric body or bodies have $d_{31}$ piezoelectric constants having magnitudes less than 20 pC/N.

15. The droplet ejector according to claim 1, wherein the mounting surface of the substrate comprises a fluid inlet aperture in fluid communication with the fluid chamber.

16. The droplet ejector according to claim 1, wherein the fluid chamber is substantially cylindrical and the nozzle portion of the nozzle-forming layer is substantially annular.

17. A printhead comprising a plurality of droplet ejectors according to claim 1.

18. The printhead according to claim 17, wherein the plurality of droplet ejectors share a common substrate.

19. A printer comprising one or more printheads according to claim 17.

20. A method of actuating a droplet ejector for a printhead, the droplet ejector comprising: a substrate having a mounting surface and an opposite nozzle surface; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the nozzle-forming layer, the nozzle portion comprising an inner portion located closer to the fluid chamber outlet and an outer portion located closer to a periphery of the nozzle portion; and an inner actuator arrangement formed on the inner portion of the nozzle portion of the nozzle-forming layer, the inner actuator arrangement comprising one or more inner piezoelectric actuators, at least one of said one or more inner piezoelectric actuators comprising an inner piezoelectric body provided between an inner pair of drive electrodes, the method comprising: actuating the inner actuator arrangement to thereby cause displacement of at least a portion of the nozzle portion of the nozzle-forming layer and consequently ejection of fluid from the fluid chamber through the fluid chamber outlet.

21. The method according to claim 20, wherein the droplet ejector comprises both inner actuator arrangement and an outer actuator arrangement formed on the outer portion of the nozzle portion of the nozzle forming layer, the method comprising: actuating both the inner actuator arrangement and the outer actuator arrangement to thereby cause displacement of at least a portion of the nozzle portion of the nozzle-forming layer and consequently ejection of fluid from the fluid chamber through the fluid chamber outlet.

22. The method according to claim 21, wherein the steps of actuating the inner actuator arrangement and actuating the outer actuator arrangement take place concurrently.

23. A droplet ejector for a printhead, the droplet ejector comprising: a substrate having a mounting surface and an opposite nozzle surface; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the nozzle-forming layer, the nozzle portion comprising an inner portion located closer to the fluid chamber outlet and an outer portion located closer to a periphery of the nozzle portion; and an outer actuator arrangement formed on the outer portion of the nozzle portion of the nozzle-forming layer, the outer actuator arrangement comprising one or more outer piezoelectric actuators, at least one of said one or more outer piezoelectric actuators comprising an outer piezoelectric body provided between an outer pair of drive electrodes.

24. A method of actuating a droplet ejector for a printhead, the droplet ejector comprising: a substrate having a mounting surface and an opposite nozzle surface; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the nozzle-forming layer, the nozzle portion comprising an inner portion located closer to the fluid chamber outlet and an outer portion located closer to a periphery of the nozzle portion; and an outer actuator arrangement formed on the outer portion of the nozzle portion of the nozzle-forming layer, the outer actuator arrangement comprising one or more outer piezoelectric actuators, at least one of said one or more outer piezoelectric actuators comprising an outer piezoelectric body provided between an outer pair of drive electrodes, the method comprising: actuating the outer actuator arrangement to thereby cause displacement of at least a portion of the nozzle portion of the nozzle-forming layer and consequently ejection of fluid from the fluid chamber through the fluid chamber outlet.

* * * * *